US009386380B2

(12) United States Patent
Chu et al.

(10) Patent No.: US 9,386,380 B2
(45) Date of Patent: Jul. 5, 2016

(54) METHOD FOR THE INTEGRATION OF A MICROELECTROMECHANICAL SYSTEMS (MEMS) MICROPHONE DEVICE WITH A COMPLEMENTARY METAL-OXIDE-SEMICONDUCTOR (CMOS) DEVICE

(71) Applicant: Taiwan Semiconductor Manufacturing Co., Ltd., Hsin-Chu (TW)

(72) Inventors: Chia-Hua Chu, Zhubei (TW); Chun-Wen Cheng, Zhubei (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 0 days.

(21) Appl. No.: 14/524,074

(22) Filed: Oct. 27, 2014

(65) Prior Publication Data

US 2016/0119722 A1 Apr. 28, 2016

(51) Int. Cl.
*H04R 19/00* (2006.01)
*H04R 19/04* (2006.01)
*H04R 31/00* (2006.01)

(52) U.S. Cl.
CPC ..... *H04R 19/005* (2013.01); *H04R 19/04* (2013.01); *H04R 31/006* (2013.01); *H04R 2201/003* (2013.01)

(58) Field of Classification Search
CPC ... H01L 41/00; H01L 27/20; B81B 2207/094; B81B 2201/0257; B81B 3/0051; H04R 19/005; H04R 19/04; H04R 2201/003
See application file for complete search history.

(56) References Cited

U.S. PATENT DOCUMENTS

2015/0102437 A1* 4/2015 Liu ..... B81B 3/0021 257/419

OTHER PUBLICATIONS

Gregor Feiertag, et al., "Packaging of MEMS microphones", Proc. SPIE 7362, Smart Sensors, Actuators, and MEMS IV, vol. 7362, p. 73620D-1-73620D-8, May 18, 2009.

* cited by examiner

*Primary Examiner* — Armando Rodriguez
(74) *Attorney, Agent, or Firm* — Eschweiler & Associates, LLC

(57) ABSTRACT

A microelectromechanical systems (MEMS) package includes a MEMS device and an integrated circuit (IC) device connected by a through silicon via (TSV). A conductive MEMS structure is arranged in a dielectric layer and includes a membrane region extending across a first volume arranged in the dielectric layer. A first substrate is bonded to a second substrate through the dielectric layer, where the MEMS device includes the second substrate. The TSV extends through the second substrate to electrically couple the MEMS device to the IC device. A third substrate is bonded to the second substrate to define a second volume between the second substrate and the third substrate, where the IC device includes the first or third substrate. A method for manufacturing the MEMS package is also provided.

20 Claims, 20 Drawing Sheets

METHOD FOR THE INTEGRATION OF A MICROELECTROMECHANICAL SYSTEMS (MEMS) MICROPHONE DEVICE WITH A COMPLEMENTARY METAL-OXIDE-SEMICONDUCTOR (CMOS) DEVICE

BACKGROUND

Microelectromechanical systems (MEMS) devices, such as accelerometers, pressure sensors, and microphones, have found widespread use in many modern day electronic devices. For example, MEMS accelerometers are commonly found in automobiles (e.g., in airbag deployment systems), tablet computers, or in smart phones. For many applications, MEMS devices are electrically connected to application-specific integrated circuits (ASICs) to form complete MEMS systems. Commonly, the connections are formed by wire bonding, but other approaches are also possible.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1A:
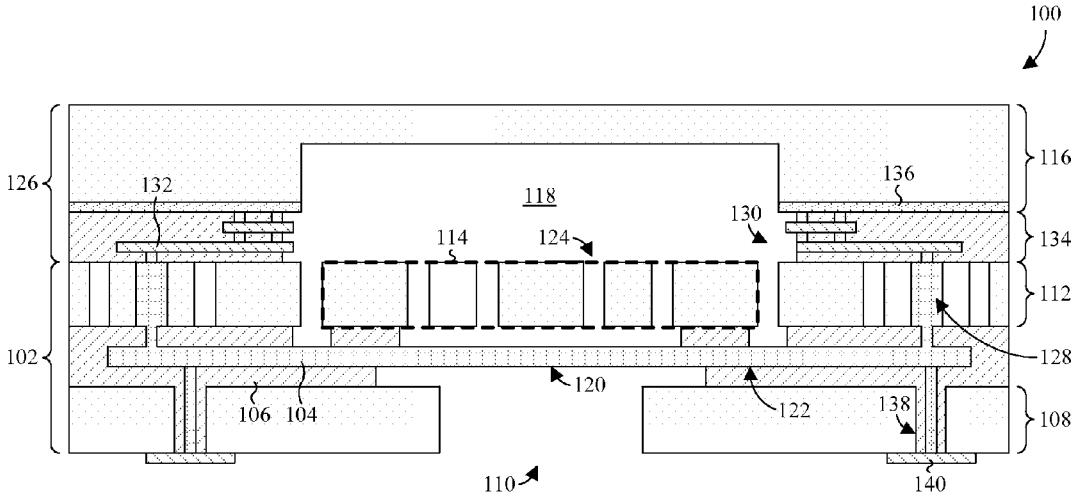
FIG. 1A illustrates a cross-sectional view of some embodiments of a microelectromechanical systems (MEMS) package including an environmental MEMS device and an integrated circuit (IC) device connected by through silicon vias (TSVs).

The present disclosure provides many different embodiments, or examples, for implementing different features of this disclosure. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Moreover, "first", "second", "third", etc. may be used herein for ease of description to distinguish between different elements of a figure or a series of figures. "first", "second", "third", etc. are not intended to be descriptive of the corresponding element. Therefore, "a first dielectric layer" described in connection with a first figure may not necessarily corresponding to a "first dielectric layer" described in connection with another figure.

Environmental microelectromechanical systems (MEMS) devices (e.g., MEMs pressure sensors, microphones, etc.) often comprise a membrane and an application-specific integrated circuits (ASIC) die located on a shared semiconductor substrate. The membrane is located over an opening in the substrate that allows the membrane to interact with an ambient environment. The membrane and ASIC die are bonded together by way of one or more bonding wires. To allow the membrane to oscillate in response to a stimuli within the ambient environment and to thereby avoid acoustic performance degradation, the membrane and ASIC are located within a back volume (i.e., a volume over the MEMS device) formed by a chip level packaging process comprising a plastic cap disposed on the shared semiconductor substrate. A challenge or drawback of packaging environmental MEMS devices according to the foregoing methods pertains to parasitic capacitance generated by the bonding wires between the ASIC and MEMS dies. An additional challenge or drawback includes cost of forming the back volume using a chip level packaging, which forms an individual package for each MEMs device.

Therefore, the present application is directed to improved methods for packaging environmental MEMS devices. The improved method uses a wafer level process to form an environmental MEMs device. The wafer level process uses bonding of ASICs to MEMS devices, as well as through silicon vias (TSVs) to connect ASICs and MEMS devices. Even more, the improved method forms the back volumes at the wafer level and, in some embodiments, includes an etch stop to prevent damage from vapor hydrofluoric acid employed for sacrificial oxide removal. The present application is also directed to the semiconductor structure of the MEMS package resulting from performance of the improved method.

With reference to FIG. 1A, a cross-sectional view 100 of some embodiments of a MEMS package including an environmental MEMS device 102 is provided. The environmental MEMS device 102 is, for example, a microphone, a pressure sensor, or any other device interfacing with the external environment.

A conductive MEMS structure 104 of the environmental MEMS device 102 is arranged in a first inter-layer dielectric (ILD) layer 106. A first side of the first ILD layer 106 abuts a first substrate 108 having an environment port 110 that is in communication with an ambient environment. A second side of the first ILD layer 106, opposite the first side, abuts a second substrate 112 within which the environmental MEMS device 102 is at least partially formed. The second substrate 112 includes a back plate electrode 114, and is further coupled to third substrate 116 to define a back volume 118 therebetween over the back plate electrode 114. In some embodiments, the first, second and third substrates 108, 112, 116 are bulk semiconductor substrates including one or more of, for example, silicon, germanium, silicon carbide, a group III element, and a group V element. In other embodiments, one or more of the first substrate 108, the second MEMS substrate 112, and the third substrate 116 are silicon-on-insulator (SOI) substrates or polysilicon-on-insulator (POI) substrates.

The conductive MEMS structure 104 includes a membrane region 120 surrounded by an anchor region 122. The membrane region 120 has a first side in communication with the environment port 110 and a second side, opposite the first side, in communication with the back volume 118. The second side of the membrane region 120 is in communication with the back volume 118 by way of one or more openings 124 in the second substrate 112. In some embodiments, an etch stop layer (not shown) is arranged in the first ILD layer 106 below the conductive MEMS structure 104 to provide a lateral etch stop for regions of the ILD layer 106 below the anchor regions 122.

In some embodiments, an integrated circuit (IC) device 126 is formed over and/or within the third substrate 116. In other embodiments, the IC device 126 is formed over a top of the first substrate 108.

One or more first TSVs 128 extend through the second substrate 112 to electrically couple the IC device 126 with the MEMS device 102, including the conductive MEMS structure 104 and the back plate electrode 114. In such embodiments, the first TSVs 128 are electrically coupled to the IC device 126 by a back-end-of-the-line (BEOL) stack 130 of the IC device 126. The BEOL stack 130 includes one or more metal layers 132 disposed within a second ILD layer 134 abutting an electronic components layer 136 of the IC device 126. Similarly, one or more second TSVs 138 extend through the first substrate 108 to electrically coupled the IC device 126 and/or the MEMS device 102 to contact pads 140 arranged on a bottom of the first substrate 108.

By forming a connection between the IC device 126 and the environmental MEMS device 102 using one or more TSVs 128, 138, the parasitic capacitance between the MEMS device 102 and the IC device 126 is reduced. Furthermore, by forming the back volume 118 of the MEMS device 102 using the third substrate 116, the overall cost of the MEMS device 102 can be reduced since the back volume 118 is formed using a wafer level process (in contrast to a package level process that forms the back volume 118 during packaging of the system).

Figure 1B:
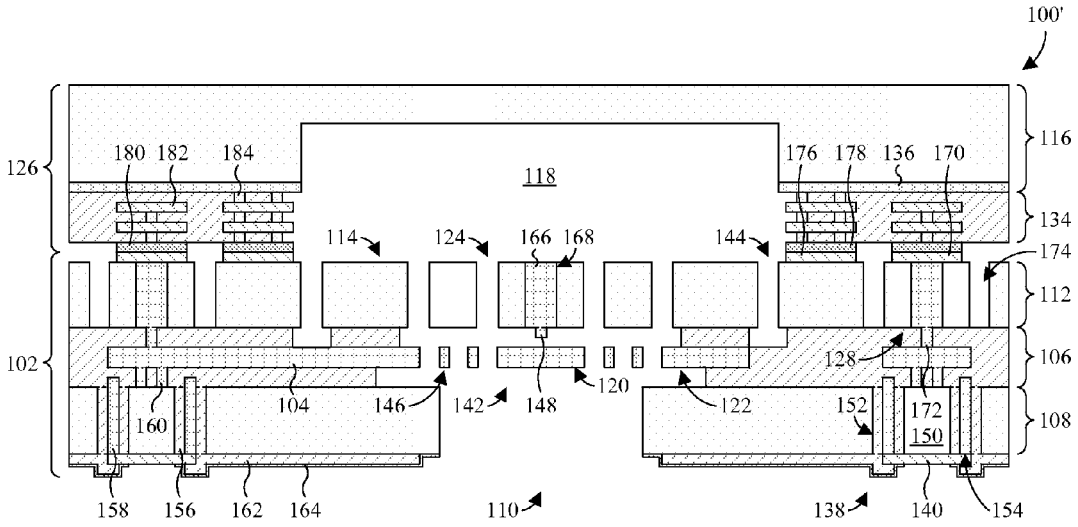
FIG. 1B illustrates a cross-sectional view of more detailed embodiments of the MEMS package of FIG. 1A.

With reference to FIG. 1B, a cross-sectional view 100' of some more detailed embodiments of a MEMS package is provided. The MEMS package includes a MEMS device 102 and an IC device 126 arranged over the MEMS device 102 with a back volume 118 arranged between the MEMS and IC devices 102, 126. The MEMS device 102 and the IC device 126 each correspond to a die, and/or a region of a wafer before singulation. The MEMS device 102 is an environmental MEMS device, such as a microphone, pressure sensor, or any other device interfacing with the external environment. The IC device 126 supports MEMS device operations and is, for example, an ASIC.

A first MEMS substrate 108 and a second MEMS substrate 112, of the MEMS device 102, are arranged vertically on opposite sides of a first ILD layer 106 of the MEMS device 102. The first and second MEMS substrates 108, 112 are substrates over and/or within which the MEMS device 102 is formed. The second MEMS substrate 112 is arranged over and bonded to the first MEMS substrate 108, typically with a fusion bond at the interface between the first ILD layer 106 and the second MEMS substrate 112. Further, a front volume 142 is arranged in the first ILD layer 106 between the first and second MEMS substrates 108, 112. The first and second MEMS substrates 108, 112 are typically bulk semiconductor substrates including, for example, one or more of silicon, germanium, silicon carbide, a group III element, and a group V element. In other embodiments, the first and second MEMS substrates 108, 112 are POI or SOI substrates. The first ILD layer 106 typically is or otherwise includes an oxide, such as silicon dioxide.

An environment port 110 extends through the first MEMS substrate 108 to the front volume 142 and inter-volume holes 124 extend through the second MEMS substrate 112 between the front and back volumes 142, 118. Further, a back plate isolation hole 144 extends through the second MEMS substrate 112 to the first ILD layer 106 around the periphery of the front volume 142. In some embodiments, the back plate isolation hole 144 further extends into the first ILD layer 106. The back plate isolation hole 144 defines a back plate electrode 114 therebetween in the second MEMS substrate 112 over the front volume 142. The back plate electrode 114 is employed for MEMS device operations, and the back plate isolation hole 144 is employed to electrically isolate the back plate electrode 114. The back plate electrode 114 typically corresponds to a highly doped region of the second MEMS substrate 112.

A conductive MEMS structure 104 of the MEMS device 102 is arranged in the first ILD layer 106 between the first and second MEMS substrates 108, 112 and extends laterally across the front volume 142. In some embodiments, the conductive MEMS structure 104 includes a membrane region 120 arranged within the front volume 142 and connected to peripheral, an anchor region 122 surrounding the membrane region 120. Where the MEMS device 102 is a microphone, the membrane region 120 is spaced from and connected to the anchor region 122 by spring regions 146. In operation, the membrane region 120 vibrates or otherwise deflects in accordance with sound received through the environment port 110. Further, capacitive coupling between the back plate electrode 114 and the membrane region 120 is employed to measure the deflection. Where the MEMS device 102 is a pressure sensor, the membrane region 120 is directly connected to the anchor region 122 and bisects the front volume 142 into two independent sub-volumes. In operation, the membrane region 120 deflects in proportion to the difference between the environmental pressure and pressure in the back volume 118. Further, capacitive coupling between the back plate electrode 114 and the membrane region 120 is employed to measure the deflection. The conductive MEMS structure 104 typically is or otherwise includes polysilicon.

A stopper 148 of the MEMS device 102 is arranged in the front volume 142 below the second MEMS substrate 112 between the second MEMS substrate 112 and the conductive MEMS structure 104. The stopper 148 stops deflecting regions of the conductive MEMS structure 104, such as the membrane region 120, from sticking to the second MEMS substrate 112 and from overextending in the vertical direction towards the second MEMS substrate 112. This advantageously reduces the likelihood of damage to the MEMS device 102 and increases the useful life of the MEMS device 102. The stopper 148 is or otherwise includes, for example, polysilicon or a dielectric, such as silicon dioxide.

First TSVs 138 of the MEMS device 102 extend through the first MEMS substrate 108 and, in some embodiments, into the first ILD layer 106. The first TSVs 138 include first conductive structures 150 arranged in corresponding first TSV holes 152. The first conductive structures 150 typically line sidewalls of the first TSV holes 152 or fill the first TSV holes 152. In some embodiments, first dielectric liners 154 of the first TSVs 138 line sidewalls of the first TSV holes 152 between the first conductive structures 150 and the sidewalls. The first dielectric liners 154 include dielectric structures 156 and, in some embodiments, conductive cores 158 arranged within the dielectric structures 156. The dielectric structures 156 typically are or otherwise include an oxide, such as silicon dioxide, and the conductive cores 158 typically are or otherwise include polysilicon. The first conductive structures 150 typically are or otherwise include highly doped silicon or semiconductor materials. The first TSVs 138 electrically couple first MEMS contact pads 140 of the MEMS device 102 arranged on the bottom of the first MEMS substrate 108 to the conductive MEMS structure 104 with first MEMS contacts 160 of the MEMS device 102. The first MEMS contacts 160 extend through the first ILD layer 106 between the conductive MEMS structure 104 and the first MEMS substrate 108, and typically are or otherwise include polysilicon or a metal, such as tungsten. The first MEMS contact pads 140 electrically couple the MEMS device 102 with external devices, and typically are or otherwise include metal, such as aluminum, copper, or aluminum copper.

A dielectric layer 162 and a corresponding protective layer 164, of the MEMS device 102, are arranged over the bottom of the first MEMS substrate 108 and, in some embodiments, partially over the first MEMS contact pads 140. The dielectric layer 162 and the protective layer 164 provide electrical insulation to the first MEMS substrate 108. Further, the protective layer 164 is arranged over a bottom of the dielectric layer 162 to protect the dielectric layer 162 from, for example, hydrofluoric acid used during the formation of the MEMS package. The dielectric layer 162 typically is or otherwise includes an oxide, such as silicon dioxide, and the protective layer 164 typically is or otherwise includes low stress nitride, aluminum nitride, aluminum oxide, or silicon carbide.

Second TSVs 128 of the MEMS device 102 extend through the second MEMS substrate 112. The second TSVs 128 include second conductive structures 166 arranged in corresponding second TSV holes 168. The second conductive structures 166 typically line sidewalls of the second TSV holes 168 or fill the second TSV holes 168. In some embodiments, second dielectric liners (not shown) of the second TSVs 128 line sidewalls of the second TSV holes 168 between the second conductive structures 166 and the sidewalls. The second dielectric liners typically are or otherwise include an oxide, such as silicon dioxide. The second conductive structures 166 typically are or otherwise include polysilicon or a metal. The second TSVs 128 electrically couple the back plate electrode 114 and second MEMS contact pads 170 to the conductive MEMS structure 104 with second MEMS contacts 172 of the MEMS device 102. The second MEMS contacts 172 extend through the first ILD layer 106 between the conductive MEMS structure 104 and the second MEMS substrate 112, and typically are or otherwise include polysilicon or a metal, such as tungsten. The second MEMS contact pads 170 are arranged on the top of the second MEMS substrate 112 and electrically couple the MEMS device 102 with the IC device 126 and, in some embodiments, with other devices. The second MEMS contact pads 170 typically are or otherwise include metal, such as aluminum, copper, aluminum copper, copper tine, or gold.

TSV isolation holes 174 of the MEMS device 102 are arranged through the second MEMS substrate 112 to the first ILD layer 106 and around the second TSVs 128. In some embodiments, the TSV isolation holes 174 extend into the first ILD layer 106. The TSV isolation holes 174 electrically isolate the second TSVs 128 from neighboring regions of the second MEMS substrate 112 with air gaps.

A MEMS bonding ring 176 of the MEMS device 102 is arranged on the MEMS device 102, and an IC bonding ring 178 of the IC device 126 is arranged over the MEMS bonding ring 176 on the IC device 126. The MEMS and IC bonding rings 176, 178 have like footprints and extend around the back volume 118. The MEMS and IC bonding rings 176, 178 bond the MEMS device 102 to the IC device 126 with a bond, typically a eutectic bond, at the interface between the MEMS and IC bonding rings 176, 178. Where the MEMS device 102 is a pressure sensor, in some embodiments, the bond hermetically seals the back volume 118 with a reference pressure employed for pressure measurements. The MEMS bonding ring 176 typically is or otherwise includes a metal, such as aluminum, copper, aluminum copper, copper tin, or gold, and the IC bonding ring 178 typically is or otherwise includes a metal, such as germanium, copper, or copper tin.

An IC substrate 116 of the IC device 126 is arranged over the second MEMS substrate 112 with a second ILD layer 134 of the IC device 126 arranged between the IC substrate 116 and the second MEMS substrate 112. The IC substrate 116 is a substrate over and/or within which the IC device 126 is formed. The back volume 118 extends from the second MEMS substrate 112, through the second ILD layer 134, and partially into the IC substrate 116. The IC substrate 116 is typically a bulk semiconductor substrate including, for example, one or more of silicon, germanium, silicon carbide, a group III element, and a group V element. In other embodiments, the IC substrate 116 is a POI or SOI substrate. The second ILD layer 134 typically is or otherwise includes an oxide, such as silicon dioxide.

An electronic components layer 136 of the IC device 126 is arranged over and/or within a bottom of the IC substrate 116. The electronic components layer 136 includes electronic components electrically connected with each other and IC contact pads 180 of the IC device 126 by interconnect components 182, 184 of the IC device 126 arranged within the second ILD layer 134. The electronic components include, for example, one or more of transistors, capacitors, resistors, inductors, and diodes. The interconnect components 182, 184 include, for example, one or more of wires 182, vias, and contacts 184. The wires 182 typically are or otherwise include a metal, such as aluminum cooper, and the vias and contacts 184 typically are or otherwise include a metal, such as tungsten. The IC contact pads 180 electrically couple the IC device 126 with the MEMS device 102 through the second MEMS contact pads 170 and, in some embodiments, with other devices. The IC contact pads 180 typically are or otherwise include metal, such as aluminum, cooper, aluminum copper, copper tin, or gold.

Figure 2:
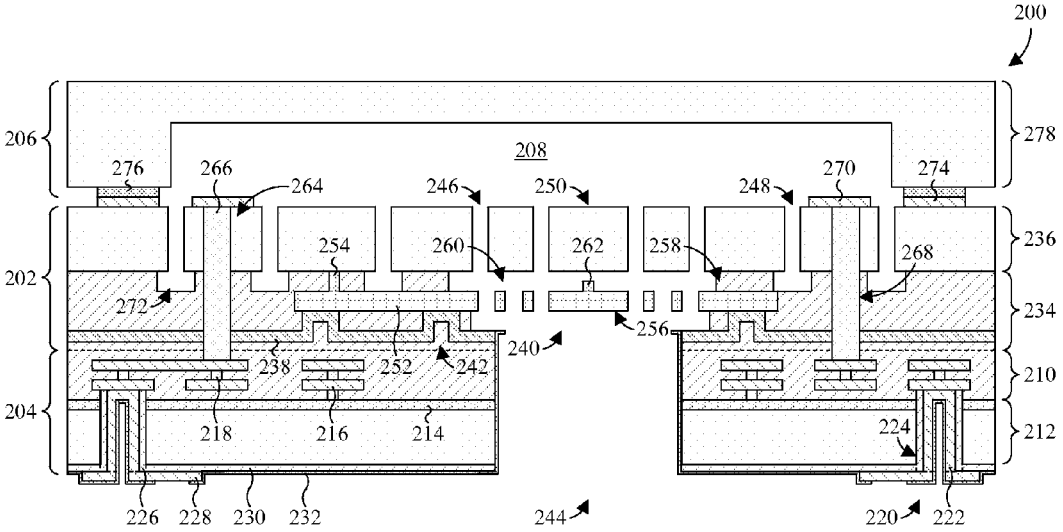
FIG. 2 illustrates a cross-sectional view of alternative embodiments of a MEMS package including an environmental MEMS device and an IC device connected by TSVs.

With reference to FIG. 2, a cross-sectional view 200 of alternative embodiments of a MEMS package is provided. The MEMS package includes a MEMS device 202 and an IC device 204 arranged over the MEMS device 202. Further, the MEMS package includes a cap device 206 arranged over the MEMS device 202 with a back volume 208 arranged between the MEMS and cap devices 202, 206. The MEMS, IC, and cap devices 202, 204, 206 each correspond to a die, and/or a region of a wafer before singulation. The MEMS device 202 is an environmental MEMS device, such as a microphone, pressure sensor, or any other device interfacing with the external environment. The IC device 204 supports MEMS device operations and is, for example, an ASIC.

A first ILD layer 210 of the IC device 204 is arranged over an IC substrate 212 of the IC device 204. The IC substrate 212 is a substrate over and/or within which the IC device 204 is arranged. An electronic components layer 214 of the IC device 204 is arranged over and/or within the IC substrate 212, and electronic components of the electronic components layer 214 are electrically connected with each other by interconnect components 216, 218 of the IC device 204 arranged within the first ILD layer 210. The electronic components include, for example, one or more of transistors, capacitors, resistors, inductors, and diodes. The interconnect components 216, 218 include, for example, one or more of wires 216, vias, and contacts 218. The wires 216 typically are or otherwise include a metal, such as aluminum, copper, or aluminum copper, and the vias and contacts 218 typically are or otherwise include a metal, such as tungsten or copper. The IC substrate 212 is typically a bulk semiconductor substrate including, for example, one or more of silicon, germanium, silicon carbide, a group III element and a group V element. In other embodiments, the IC substrate 212 is a POI or SOI substrate. The first ILD layer 210 typically is or otherwise includes an oxide, such as silicon dioxide.

First TSVs 220 of the IC device 204 extend through the IC substrate 212 into the first ILD layer 210 to the interconnect components 216, 218. The first TSVs 220 include first conductive structures 222 arranged in corresponding first TSV holes 224. The first conductive structures 222 typically line sidewalls of the first TSV holes 224 or fill the first TSV holes 224. In some embodiments, first dielectric liners 226 of the first TSVs 220 line sidewalls of the first TSV holes 224 between the first conductive structures 222 and the sidewalls. The first dielectric liners 226 typically are or otherwise include an oxide, such as silicon dioxide. The first conductive structures 222 typically are or otherwise include a metal, such as aluminum, copper, or aluminum copper. The first TSVs 220 electrically couple IC contact pads 228 of the IC device 204 arranged on the bottom of the IC substrate 212 to the interconnect components 216, 218. The IC contact pads 228 electrically couple the IC device 204 with external devices, and typically are or otherwise include metal, such as aluminum, copper, or aluminum copper.

A dielectric layer 230 and a corresponding protective layer 232, of the IC device 204, are arranged over the bottom of the IC substrate 212. The dielectric layer 230 is arranged between the IC substrate 212 and the IC contact pads 228 for electrical isolation. Further, the protective layer 232 is arranged over the bottom of the dielectric layer 230 to protect the dielectric layer 230 from, for example, hydrofluoric acid used during the formation of the MEMS package. In some embodiments, the protective layer 232 extends partially over the IC contact pads 228 and/or lines the first conductive structures 222. The dielectric layer 230 typically is or otherwise includes an oxide, such as silicon dioxide, and the protective layer 232 typically is or otherwise includes low stress nitride, aluminum nitride, aluminum oxide, or silicon carbide.

A second ILD layer 234 of the MEMS device 202 is arranged over the first ILD layer 210 between the first ILD layer 210 and a MEMS substrate 236 of the MEMS device 202. The MEMS substrate 236 is a substrate over and/or within which the MEMS device 202 is arranged. Typically, the MEMS device 202 is bonded to the IC device 204 by a fusion bond at the interface between the first and second ILD layers 210, 234. An etch stop layer 238 is arranged in the second ILD layer 234, and a front volume 240 is arranged in the second ILD layer 234 over the etch stop layer 238 between the etch stop layer 238 and the MEMS substrate 236. In some embodiments, the etch stop layer 238 includes ridges 242 extending vertically up towards the MEMS substrate 236 to define a lateral etch stop for sidewalls of the front volume 240 and to define an anchor region of the second ILD layer 234 around the periphery of the front volume 240. The etch stop layer 238 typically is or otherwise includes low stress nitride, aluminum nitride, aluminum oxide, or silicon carbide. The MEMS substrate 236 is typically a bulk semiconductor substrate including, for example, one or more of silicon, germanium, silicon carbide, a group III element, and a group V element. However, in other embodiments, the MEMS substrate 236 is a SOI substrate or a POI substrate. The second ILD layer 234 typically is or otherwise includes an oxide, such as silicon dioxide.

An environment port 244 extends through the IC substrate 212 and first ILD layer 210 to the front volume 240 and inter-volume holes 246 extend through the MEMS substrate 236 between the front and back volumes 240, 208. In some embodiments, the protective layer 232 lines sidewalls of the environment port 244. Further, a back plate isolation hole 248 extends through the MEMS substrate 236 to the second ILD layer 234 around the periphery of the front volume 240. In some embodiments, the back plate isolation hole 248 further extends into the second ILD layer 234. The back plate isolation hole 248 defines a back plate electrode 250 therebetween in the MEMS substrate 236 over the front volume 240. The back plate electrode 250 is employed for MEMS device operations, and the back plate isolation hole 248 is employed to electrically isolate the back plate electrode 250. The back plate electrode 250 typically corresponds to a highly doped region of the MEMS substrate 236.

A conductive MEMS structure 252 of the MEMS device 202 is arranged in the second ILD layer 234 between the IC and MEMS substrates 212, 236, and extends laterally across the front volume 240. In some embodiments, the conductive MEMS structure 252 is arranged over and abutting the ridges 242 of the etch stop layer 238. The conductive MEMS structure 252 is connected to regions of the MEMS substrate 236 surrounding the back plate electrode 250 by a MEMS contact 254 of the MEMS device 202. The MEMS contact 254 typically is or otherwise includes polysilicon. In some embodiments, the conductive MEMS structure 252 includes a membrane region 256 arranged within the front volume 240 and connected to peripheral, an anchor region 258 surrounding the membrane region 256. Where the MEMS device 202 is a microphone, the membrane region 256 is spaced from and connected to the anchor region 258 by spring regions 260. In operation, the membrane region 256 vibrates or otherwise deflects in accordance with sound received through the environment port 244. Further, capacitive coupling between the back plate electrode 250 and the membrane region 256 is employed to measure the deflection. Where the MEMS device 202 is a pressure sensor, the membrane region 256 is directly connected to the anchor region 258 and bisects the front volume 240 into two independent sub-volumes. In operation, the membrane region 256 deflects in proportion to the difference between the environmental pressure and pressure in the back volume 208. Further, capacitive coupling between the back plate electrode 250 and the membrane region 256 is employed to measure the deflection. The conductive MEMS structure 252 typically is or otherwise includes polysilicon.

A stopper 262 of the MEMS device 202 is arranged in the front volume 240 over the top of the conductive MEMS structure 252 between the MEMS substrate 236 and the conductive MEMS structure 252. The stopper 262 stops deflecting regions of the conductive MEMS structure 252, such as the membrane region 256, from sticking to the MEMS substrate 236 and from overextending in the vertical direction towards the MEMS substrate 236. This advantageously reduces the likelihood of damage to the MEMS device 202 and increases the useful life of the MEMS device 202. The stopper 262 is or otherwise includes, for example, polysilicon or a dielectric, such as silicon dioxide.

Second TSVs 264 of the MEMS device 202 extend through the MEMS substrate 236, the second ILD layer 234, and into the first ILD layer 210 to the interconnect components 216, 218. The second TSVs 264 include second conductive structures 266 arranged in corresponding second TSV holes 268. The second conductive structures 266 typically line sidewalls of the second TSV holes 268 or fill the second TSV holes 268. In some embodiments, second dielectric liners (not shown) line sidewalls of the second TSV holes 268 between the second conductive structures 266 and the sidewalls. The second dielectric liners typically are or otherwise include an oxide, such as silicon dioxide. The second conductive structures 266 typically are or otherwise include a metal, such as tungsten. The second TSVs 264 electrically couple the MEMS substrate 236, including the back plate electrode 250, and, in some embodiments, MEMS contact pads 270 to the interconnect components 216, 218. The MEMS contact pads 270 are arranged on the top of the MEMS substrate 236, and improve the electrical interface between the second TSVs 264 and the MEMS substrate 236. The MEMS contact pads 270 typically are or otherwise include metal, such as aluminum, copper, or aluminum copper.

TSV isolation holes 272 of the MEMS device 202 are arranged around the second TSVs 264 through the MEMS substrate 236 to the second ILD layer 234. In some embodiments, the TSV isolation holes 272 extend into the second ILD layer 234. The TSV isolation holes 272 electrically isolate the second TSVs 264 from neighboring regions of the MEMS substrate 236 with air gaps.

A MEMS bonding ring 274 of the MEMS device 202 is arranged on the MEMS substrate 236, and a cap bonding ring 276 of the cap device 206 is arranged over the MEMS bonding ring 274 on a cap substrate 278 of the cap device 206. The cap substrate 278 is a substrate over and/or within which the cap device 206 is arranged. The cap substrate 278 includes the back volume 208, and is typically a bulk semiconductor substrate including, for example, one or more of silicon, germanium, silicon carbide, a group III element, and a group V element. In other embodiments, the cap substrate 278 is a SOI or POI substrate. The MEMS and cap bonding rings 274, 276 have like footprints and extend around the back volume 208. The MEMS and cap bonding rings 274, 276 bond the MEMS device 202 to the cap device 206 with a bond, typically a eutectic bond, at the interface between the MEMS and cap bonding rings 274, 276. Where the MEMS device 202 is a pressure sensor, in some embodiments, the bond hermetically seals the back volume 208 with a reference pressure employed for pressure measurements. The MEMS bonding ring 274 typically is or otherwise includes a metal, such as aluminum, copper, aluminum copper, copper tin, or gold, and the cap bonding ring 276 typically is or otherwise includes a metal, such as germanium, copper, or copper tin.

Advantageously, the MEMS packages of FIGS. 1 and 2 can be formed at the wafer level using TSVs. Wafer-level formation reduces parasitic capacitances between MEMS devices and the corresponding IC devices. Further, wafer-level formation reduces costs since the MEMS devices are packaged with the corresponding IC devices in bulk. In addition to the benefits that flow from wafer-layer formation, the MEMS package of FIG. 2 advantageously includes an etch stop layer to protect the IC device from damage during packaging.

Figure 3:
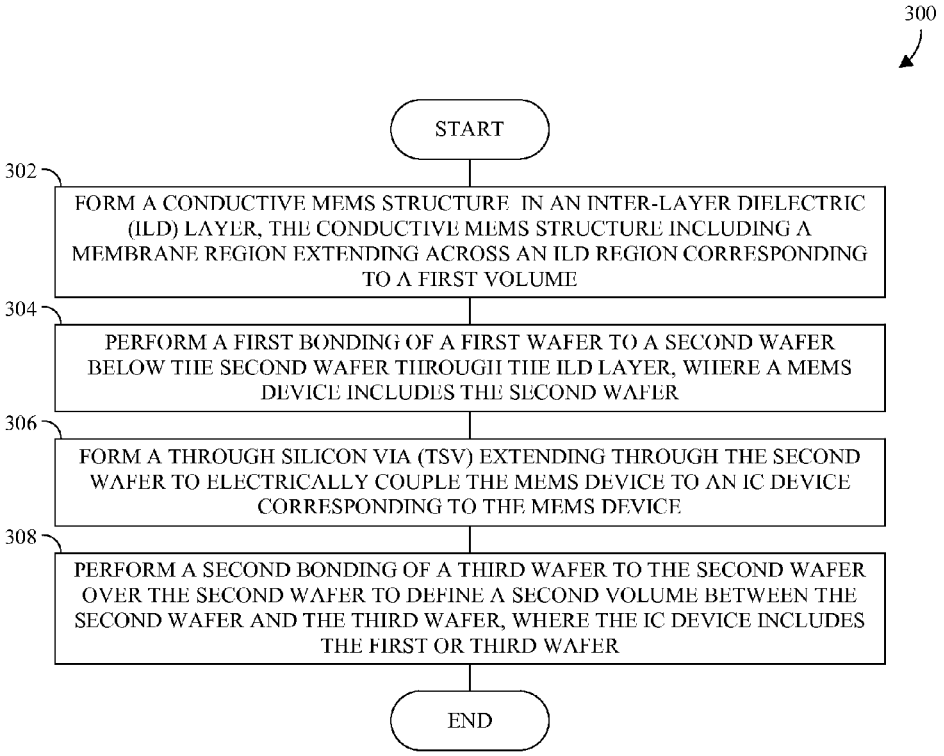
FIG. 3 illustrates a flow chart of some embodiments of a method for manufacturing a MEMS package including an environmental MEMS device and an IC device connected by TSVs.

With reference to FIG. 3, a flowchart 300 provides some embodiments of a method for manufacturing a MEMS package including a MEMS device and an IC device connected by TSVs. The MEMS device is an environmental MEMS device, such as a microphone, pressure sensor, or other device interfacing with the external environment. Examples of the MEMS package are shown in FIGS. 1 and 2.

A conductive MEMS structure is formed (Action 302) in an ILD layer. The conductive MEMS structure includes a membrane region extending across an ILD region corresponding to a first volume. For a microphone, the membrane region is suspended within the first volume by spring regions of the conductive MEMS structure connecting the membrane region to an anchor region of the conductive MEMS structure around the periphery of the first volume.

A first bonding of a first wafer is performed (Action 304) to a second wafer below the second wafer through the ILD layer, where a MEMS device includes the second wafer.

A TSV is formed (Action 306) extending through the second wafer to electrically couple the MEMS device to an IC device corresponding to the MEMS device.

A second bonding of a third wafer is performed (Action 308) to the second wafer over the second wafer to define a second volume between the second wafer and the third wafer. The IC device includes the first or third wafer.

Figure 4A:
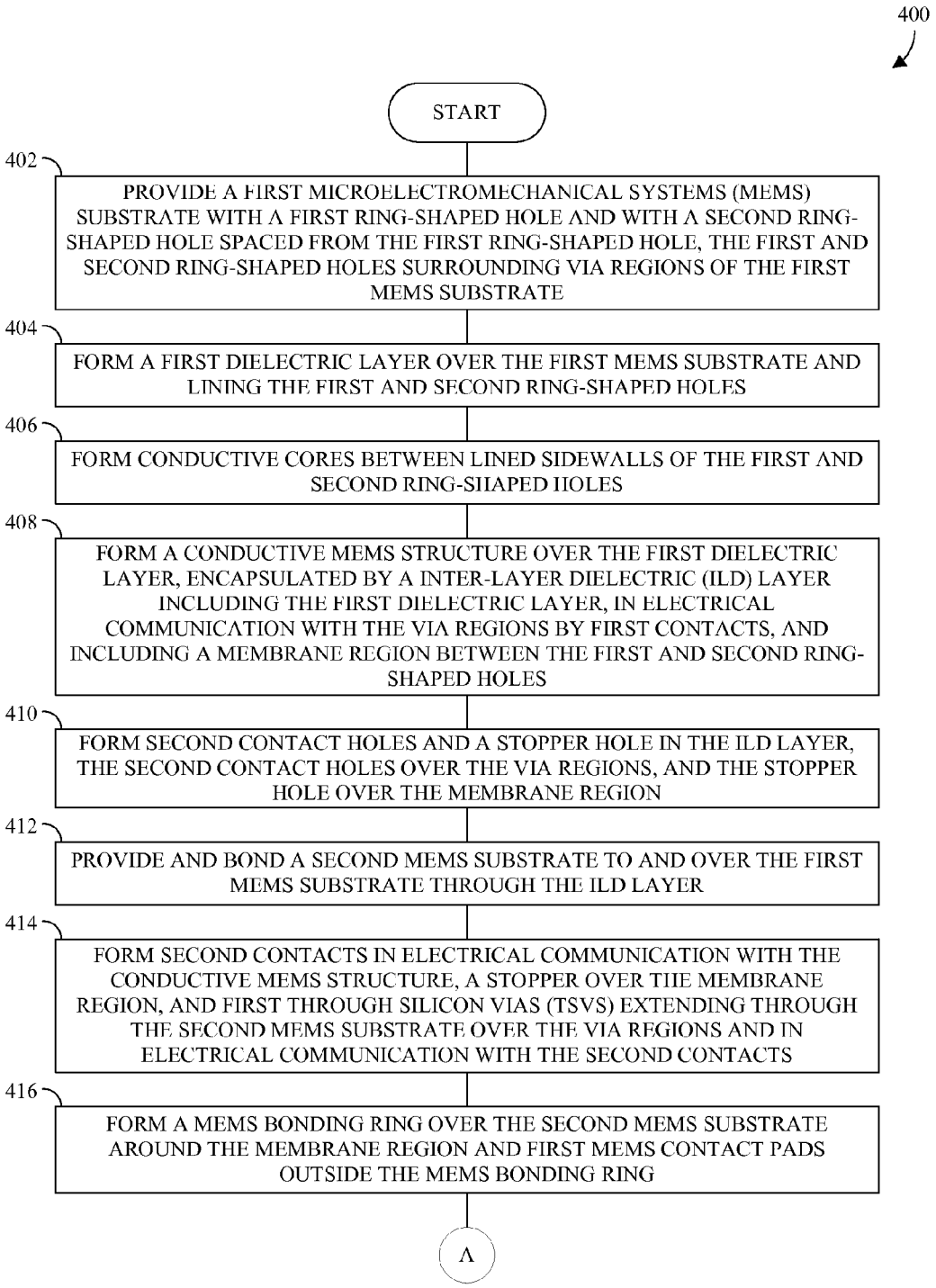
FIGS. 4A & 4B illustrate flow charts of alternative embodiments of a method for manufacturing a MEMS package including an environmental MEMS device and an IC device connected by TSVs.
Figure 4B:
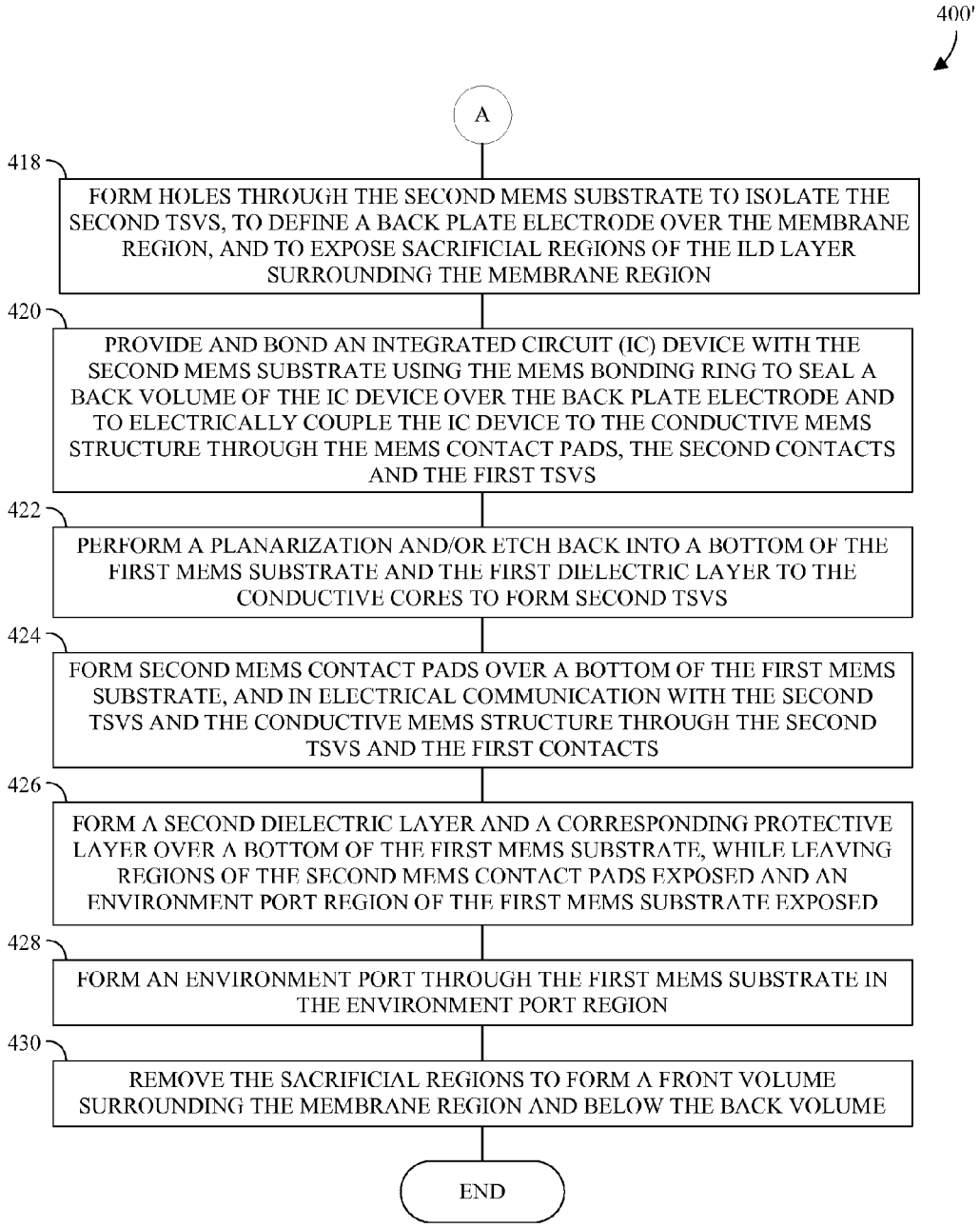

With reference to FIGS. 4A & B, flow charts 400, 400' of some embodiments of the method for manufacturing the MEMS package of FIG. 1B is provided.

A first MEMS substrate is provided (Action 402) with a first ring-shaped hole and with a second ring-shaped hole spaced from the first ring-shaped hole, the first and second ring-shaped holes surrounding via regions of the first MEMS substrate.

A first dielectric layer is formed (Action 404) over the first MEMS substrate and lining the first and second ring-shaped holes.

Conductive cores are formed (Action 406) between lined sidewalls of the first and second ring-shaped holes.

A conductive MEMS structure is formed (Action 408) over the first dielectric layer, encapsulated by an ILD layer including the first dielectric layer, in electrical communication with the via regions by first contacts, and including a membrane region between the first and second ring-shaped holes.

Second contact holes and a stopper hole are formed (Action 410) in the ILD layer, the second contacts over the via regions, and the stopper hole over the membrane region.

A second MEMS substrate is provided and bonded (Action 412) to and over the first MEMS substrate through the ILD layer.

Second contacts in electrical communication with the conductive MEMS structure, a stopper over the membrane region, and first TSVs extending through the second MEMS substrate over the via regions and in electrical communication with the second contacts, are formed (Action 414).

A MEMS bonding ring over the second MEMS substrate around the membrane region, and first MEMS contact pads outside the MEMS bonding ring, are formed (Action 416).

Holes through the second MEMS substrate to isolate the second TSVs, to define a back plate electrode over the membrane region, and to expose sacrificial regions of the ILD layer surrounding the membrane region, are formed (Action 418).

An IC device is provided and bonded (Action 420) with the second MEMS substrate using the MEMS bonding ring to seal a back volume of the IC device over the back plate electrode and to electrically couple the IC device to the conductive MEMS structure through the MEMS contact pads, the second contacts and the first TSVs.

A planarization and/or etch back is performed (Action 422) into a bottom of the first MEMS substrate and the first dielectric layer to the conductive cores to form second TSVs.

Second MEMS contact pads are formed (Action 424) over a bottom of the first MEMS substrate, and in electrical communication with the second TSVs and the conductive MEMS structure through the second TSVs and the first contacts.

A second dielectric layer and a corresponding protective layer are formed (Action 426) over a bottom of the first MEMS substrate, while leaving regions of the second MEMS contact pads exposed and an environment port region of the first MEMS substrate exposed.

An environment port is formed (Action 428) through the first MEMS substrate in the environment port region.

The sacrificial regions are removed (Action 430) to form a front volume surrounding the membrane region and below the back volume.

Figure 5A:
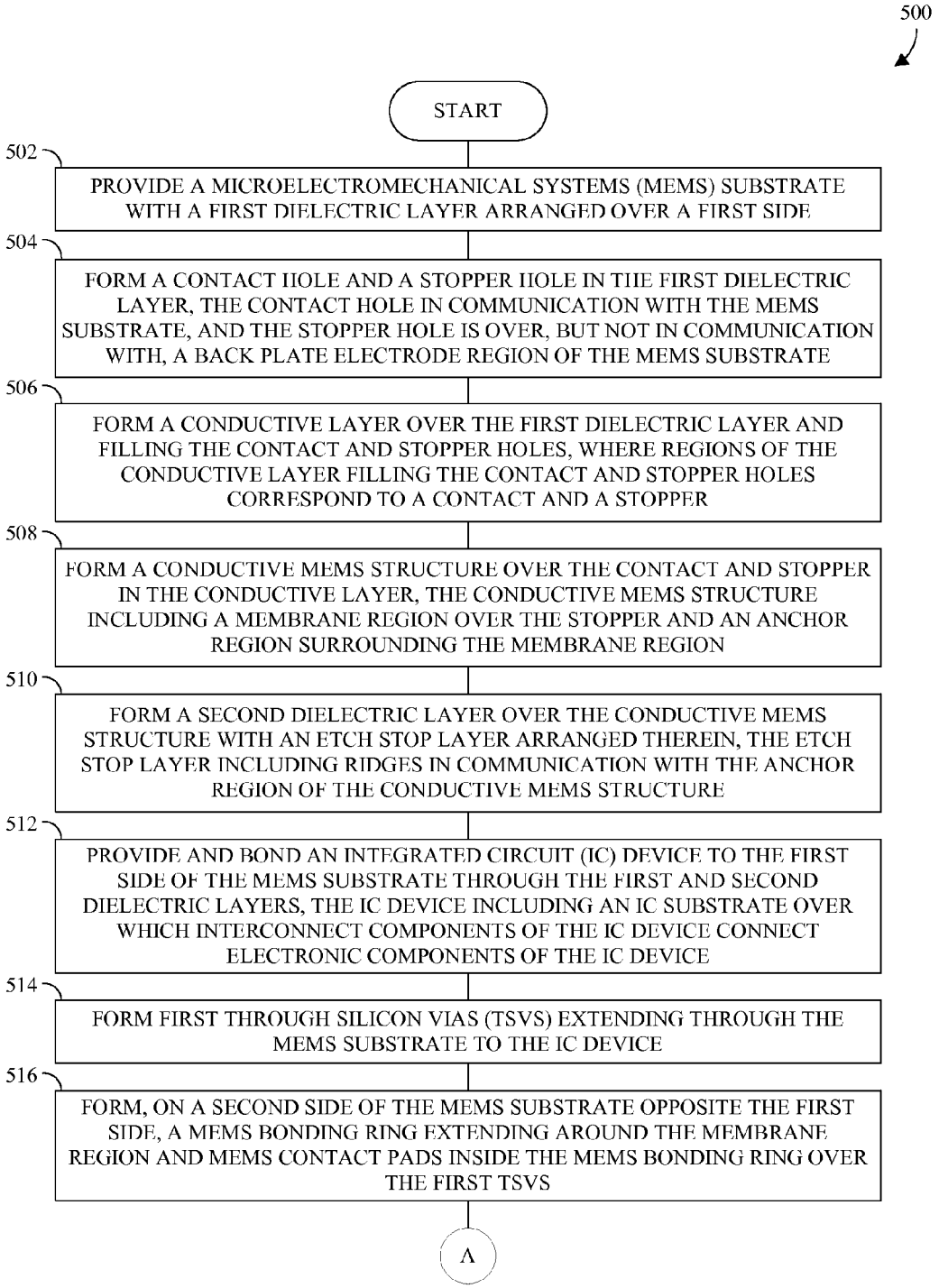
FIGS. 5A & 5B illustrate flow charts of additional alternative embodiments of a method for manufacturing a MEMS package including an environmental MEMS device and an IC device connected by TSVs.
Figure 5B:
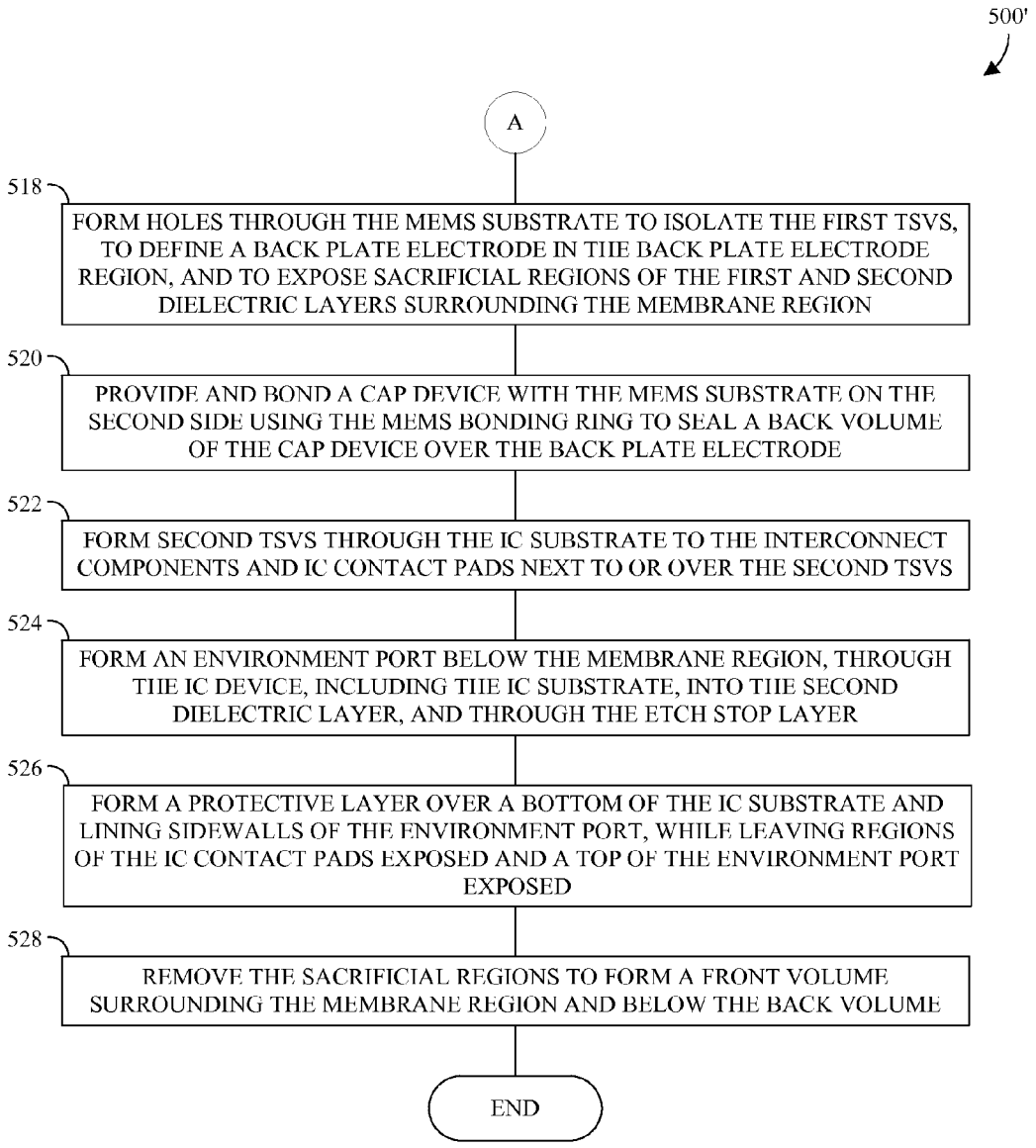

With reference to FIGS. 5A & B, flow charts 500, 500' of some embodiments of the method for manufacturing the MEMS package of FIG. 2 is provided.

A MEMS substrate is provided (Action 502) with a first dielectric layer arranged over a first side.

A contact hole and a stopper hole are formed (Action 504) in the first dielectric layer. The contact hole is in communication with the MEMS substrate, and the stopper hole is over, but not in communication with, a back plate electrode region of the MEMS substrate.

A conductive layer is formed (Action 506) over the first dielectric layer and filling the contact and stopper holes. Regions of the conductive layer filling the contact and stopper holes correspond to a contact and a stopper.

A conductive MEMS structure is formed (Action 508) over the contact and stopper in the conductive layer. The conductive MEMS structure includes a membrane region over the stopper and an anchor region surrounding the membrane region.

A second dielectric layer is formed (Action 510) over the conductive MEMS structure with an etch stop layer arranged therein. The etch stop layer includes ridges in communication with the anchor region of the conductive MEMS structure.

An IC device is provided and bonded (Action 512) to the first side of the MEMS substrate through the first and second dielectric layers. The IC device includes an IC substrate over which interconnect components of the IC device connect electronic components of the IC device.

First TSVs are formed (Action 514) extending through the MEMS substrate to the IC device.

On a second side of the MEMS substrate opposite the first side, a MEMS bonding ring extending around the membrane region and MEMS contact pads inside the MEMS bonding ring over the first TSVs are formed (Action 516).

Holes are formed (Action 518) through the MEMS substrate to isolate the first TSVs, to define a back plate electrode in the back plate electrode region, and to expose sacrificial regions of the first and second dielectric layers surrounding the membrane region.

A cap device is provided and bonded (Action 520) with the MEMS substrate on the second side using the MEMS bonding ring to seal a back volume of the cap device over the back plate electrode.

Second TSVs through the IC substrate to the interconnect components, and IC contact pads next to or over the second TSVs, are formed (Action 522).

An environment port is formed (Action 524) below the membrane region, through the IC device, including the IC substrate, into the second dielectric layer, and through the etch stop layer.

A protective layer is formed (Action 526) over a bottom of the IC substrate and lining sidewalls of the environment port, while leaving regions of the IC contact pads exposed and a top of the environment port exposed.

The sacrificial regions are removed (Action 528) to form a front volume surrounding the membrane region and below the back volume.

Advantageously, the methods of FIGS. 3, 4A & B, and 5A & B are performed at the wafer level using TSVs. Wafer-level formation of MEMS packages reduces parasitic capacitances between MEMS devices and the corresponding IC devices. Further, wafer-level formation reduces costs since the MEMS devices are packaged with the corresponding IC devices in bulk. In addition to the benefits that flow from wafer-layer formation, the methods of FIGS. 5A & B employ an etch stop layer to protect the IC device from damage during packaging.

While the disclosed methods (e.g., the method described by the flowcharts 300, 400, 400', 500, 500') are illustrated and described herein as a series of acts or events, it will be appreciated that the illustrated ordering of such acts or events are not to be interpreted in a limiting sense. For example, some acts may occur in different orders and/or concurrently with other acts or events apart from those illustrated and/or described herein. Further, not all illustrated acts may be required to implement one or more aspects or embodiments of the description herein, and one or more of the acts depicted herein may be carried out in one or more separate acts and/or phases.

With reference to FIGS. 6-19, cross-sectional views of some embodiments of a MEMS package at various stages of manufacture are provided to illustrate the method of FIGS. 4A & B. Although FIGS. 6-19 are described in relation to the method, it will be appreciated that the structures disclosed in FIGS. 6-19 are not limited to the method, but instead may stand alone as structures independent of the method. Similarly, although the method is described in relation to FIGS. 6-19, it will be appreciated that the method is not limited to the structures disclosed in FIGS. 6-19, but instead may stand alone independent of the structures disclosed in FIGS. 6-19.

Figure 6:
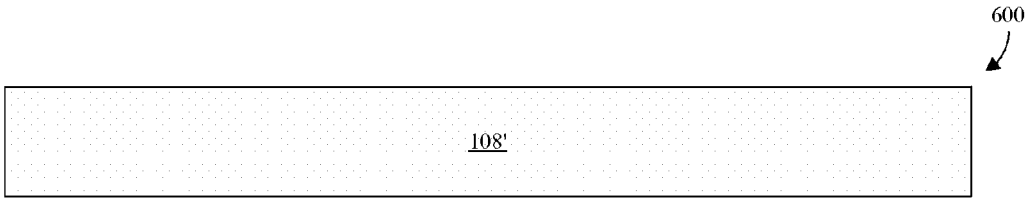
FIGS. 6-32 illustrate a series of cross-sectional views of some embodiments of a MEMS package at various stages of manufacture, the MEMS package including an environmental MEMS device and an IC device connected by TSVs.
Figure 7:
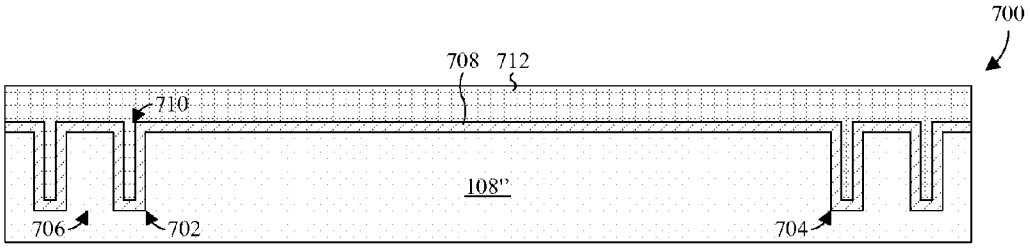

FIGS. 6 and 7 illustrate cross-sectional views 600, 700 of some embodiments corresponding to Actions 402 and 404.

As shown by FIG. 6, a first MEMS substrate 108' is provided. The first MEMS substrate 108' is a substrate over and/or within which a MEMS device is formed. In some embodiments, the first MEMS substrate 108' is a bulk semiconductor substrate including, for example, one or more of silicon, germanium, silicon carbide, a group III element, and a group V element. Alternatively, in other embodiments, the first MEMS substrate 108' is a SOI or POI substrate.

As shown by FIG. 7, a first etch is performed into select regions of the first MEMS substrate 108' to define a first ring-shaped hole 702 and a second ring-shaped hole 704 spaced from the first ring-shaped hole 702. The first and second ring-shaped holes 702, 704 surround silicon via regions 706 of the remaining first MEMS substrate 108". The first etch includes, for example, one or more sub-etches, each of which is anisotropic, isotropic, or a combination of anisotropic and isotropic, and each of which is a wet etch, a dry etch (e.g., a plasma etch), or a combination of wet and dry etches Also shown by FIG. 7, a first dielectric layer 708 is formed over the remaining first MEMS substrate 108". Further, the first dielectric layer 708 is formed lining the first and second ring-shaped holes 702, 704, while leaving gaps 710 between the lined sidewalls of the first and second ring-shaped holes 702, 704. The first dielectric layer 708 is or otherwise includes a dielectric, such as, for example, silicon dioxide, silicon oxynitride, or silicon nitride. Typically, the first dielectric layer 708 is conformally formed and/or formed of an oxide, such as silicon dioxide.

Figure 8:
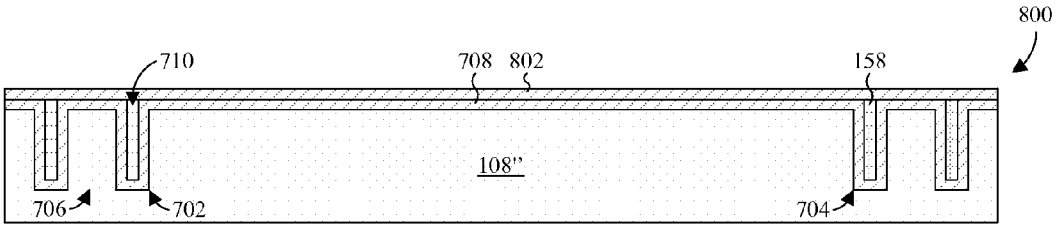

FIGS. 7 and 8 illustrate cross-sectional views 700, 800 of some embodiments corresponding to Action 406.

As shown by FIG. 7, a first conductive layer 712 is formed over the first dielectric layer 708 and filling the gaps 710 between the lined sidewalls of the first and second ring-shaped holes 702, 704. The first conductive layer 712 is or otherwise includes a conductor, such as polysilicon or a metal. Typically, the first conductive layer 712 is formed of polysilicon.

As shown by FIG. 8, a first planarization and/or etch back is performed into the first conductive layer 712 to the first dielectric layer 708. The first planarization and/or etch back forms conductive cores 158 between the lined sidewalls of the first and second ring-shaped holes 702, 704. In some embodiments, the first planarization and/or etch back includes a chemical-mechanical planarization (CMP).

FIGS. 8-11 illustrate cross-sectional views 800, 900, 1000, 1100 of some embodiments corresponding to Action 408.

As shown by FIG. 8, a second dielectric layer 802 is formed over the first dielectric layer 708 and the conductive cores 158. The second dielectric layer 802 is or otherwise includes a dielectric, such as, for example, silicon dioxide, silicon oxynitride, or silicon nitride. Typically, the second dielectric layer 802 is formed of an oxide, such as silicon dioxide.

Figure 9:
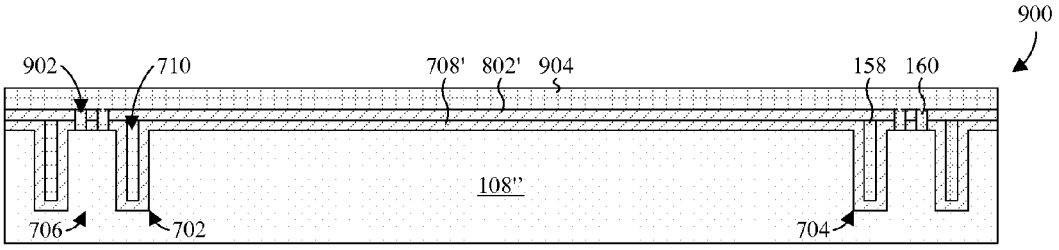

As shown by FIG. 9, a second etch is performed through select regions of the first and second dielectric layers 708, 802. The second etch forms first contact holes 902 over the silicon via regions 706. The second etch includes, for example, one or more sub-etches, each of which is anisotropic, isotropic, or a combination of anisotropic and isotropic, and each of which is a wet etch, a dry etch (e.g., a plasma etch), or a combination of wet and dry etches Also shown by FIG. 9, a second conductive layer 904 is formed over the remaining second dielectric layer 802' and filling the first contact holes 902. Regions of the second conductive layer 904 filling the first contact holes 902 correspond to first MEMS contacts 160. The second conductive layer 904 is or otherwise includes a conductor, such as polysilicon or a metal. Typically, the second conductive layer 904 is polysilicon.

Figure 10:
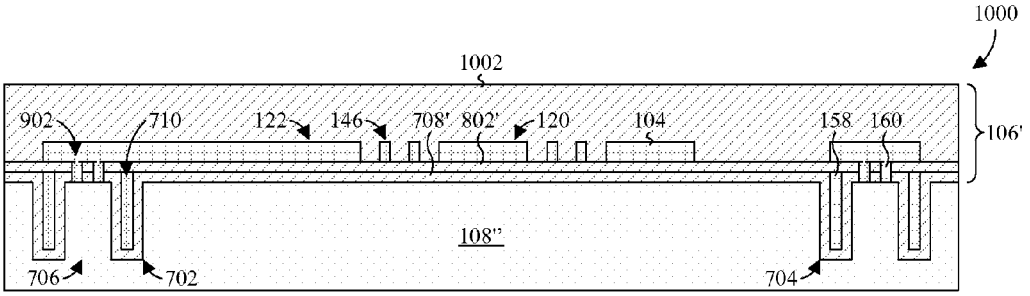

As shown by FIG. 10, a third etch is performed into select regions of the second conductive layer 904. The third etch forms a conductive MEMS structure 104 arranged over and in electrical communication with the first MEMS contacts 160. The conductive MEMS structure 104 is tailored to a predetermined type of MEMS device, such as, for example, a microphone, pressure sensor, or any other type of MEMS device requiring environmental exposure. For a microphone, the conductive MEMS structure 104 includes an anchor region 122 arranged around and spaced from a membrane region 120, and connected to the membrane region 120 by spring regions 146. For a pressure sensor, the conductive MEMS structure 104 includes the anchor region 122 directly connected to the membrane region 120. The third etch includes, for example, one or more sub-etches, each of which is anisotropic, isotropic, or a combination of anisotropic and isotropic, and each of which is a wet etch, a dry etch (e.g., a plasma etch), or a combination of wet and dry etches Also shown by FIG. 10, a third dielectric layer 1002 is formed over the remaining second dielectric layer 802' and the conductive MEMS structure 104. The remaining first and second dielectric layers 708', 802' and the third dielectric layers 1002 collectively define a first ILD layer 106' encapsulating the conductive MEMS structure 104. The third dielectric layer 1002 is or otherwise includes a dielectric, such as, for example, silicon dioxide, silicon oxynitride, or silicon nitride. Typically, the third dielectric layer 1002 is formed of an oxide, such as silicon dioxide.

Figure 11:
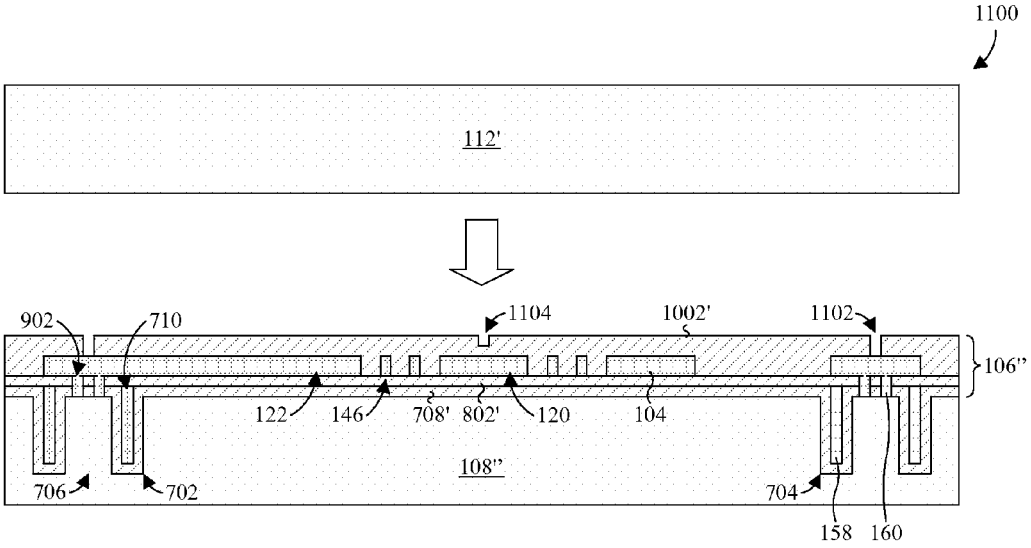

As shown by FIG. 11, a second planarization and/or etch back is performed into the first ILD layer 106', including the third dielectric layer 1002. In some embodiments, the second planarization and/or etch back includes a CMP.

FIG. 11 illustrates a cross-sectional view 1100 of some embodiments corresponding to Actions 410 and 412.

As shown by FIG. 11, a fourth etch is performed into select regions of the third dielectric and first ILD layers 1002, 106' to form second contact holes 1102 in communication with the conductive MEMS structure 104. Typically, the second contact holes 1102 are in communication with the anchor region 122 of the conductive MEMS structure 104, and/or arranged over the silicon via regions 706. The fourth etch includes, for example, one or more sub-etches, each of which is anisotropic, isotropic, or a combination of anisotropic and isotropic, and each of which is a wet etch, a dry etch (e.g., a plasma etch), or a combination of wet and dry etches Also shown by FIG. 11, a fifth etch is performed into select regions of the third dielectric and first ILD layers 1002, 106' to form a stopper hole 1104 over the membrane region 120, but not in communication with the membrane region 120. Typically, the stopper hole 1104 is arranged over the center of the membrane region 120. The fifth etch includes, for example, one or more sub-etches, each of which is anisotropic, isotropic, or a combination of anisotropic and isotropic, and each of which is a wet etch, a dry etch (e.g., a plasma etch), or a combination of wet and dry etches Also shown by FIG. 11, a second MEMS substrate 112' is provided. Like remaining first MEMS substrate 108", the second MEMS substrate 112' is a substrate over and/or within which a MEMS device is formed. In some embodiments, the second MEMS substrate 112' is a bulk semiconductor substrate including, for example, one or more of silicon, germanium, silicon carbide, a group III element, and a group V element. Alternatively, the second MEMS substrate 112' is, for example, a SOI or POI substrate.

Also shown by FIG. 11, the second MEMS substrate 112' is bonded to the remaining first MEMS substrate 108" through the remaining first ILD layer 106", including the remaining third dielectric layer 1002'. The second MEMS substrate 112' is typically bonded to the remaining first MEMS substrate 108" by a fusion bond at the interface between the second MEMS substrate 112' and the remaining third dielectric layer 1002'.

Figure 12:
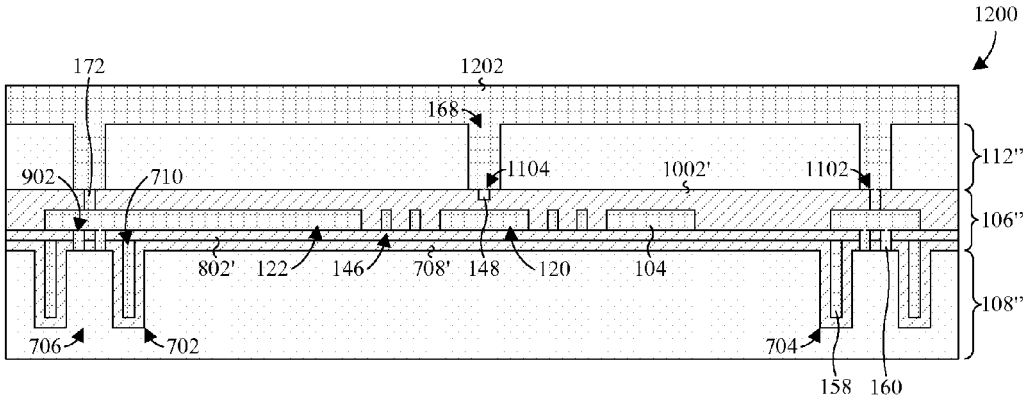
Figure 13:
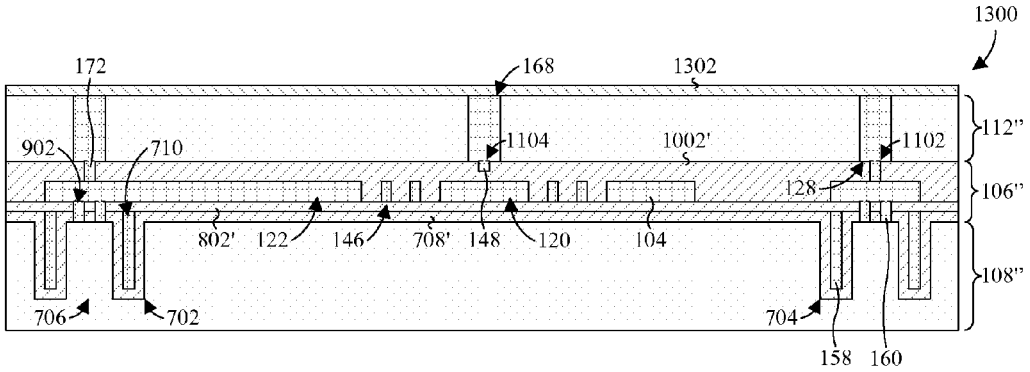

FIGS. 12 and 13 illustrate cross-sectional views 1200, 1300 of some embodiments corresponding to Action 414.

As shown by FIG. 12, third planarization and/or etch back is performed into the second MEMS substrate 112' to thin down the second MEMS substrate 112' to the desired thickness. In some embodiments, the third planarization and/or etch back includes a CMP.

Also shown by FIG. 12, a sixth etch is performed through select regions of the second MEMS substrate 112' to define second TSV holes 168 over the stopper hole 1104 and over the second contact holes 1102. The sixth etch includes, for example, one or more sub-etches, each of which is anisotropic, isotropic, or a combination of anisotropic and isotropic, and each of which is a wet etch, a dry etch (e.g., a plasma etch), or a combination of wet and dry etches Also shown by FIG. 12, a third conductive layer 1202 is formed over the remaining second MEMS substrate 112", and filling the second TSV holes 168, the stopper hole 1104, and the second contact holes 1102. Regions of the third conductive layer 1202 filling the second contact holes 1102 correspond to second MEMS contacts 172, and regions of the third conductive layer 1202 filling the stopper hole 1104 correspond to a stopper 148. The third conductive layer 1202 is or otherwise includes a conductor, such as polysilicon or a metal. Typically, the third conductive layer 1202 is polysilicon.

As shown by FIG. 13, a fourth planarization and/or etch back is performed into the third conductive layer 1202 to the remaining second MEMS substrate 112" to form second TSVs 128. In some embodiments, the fourth planarization and/or etch back includes a CMP.

Figure 14:
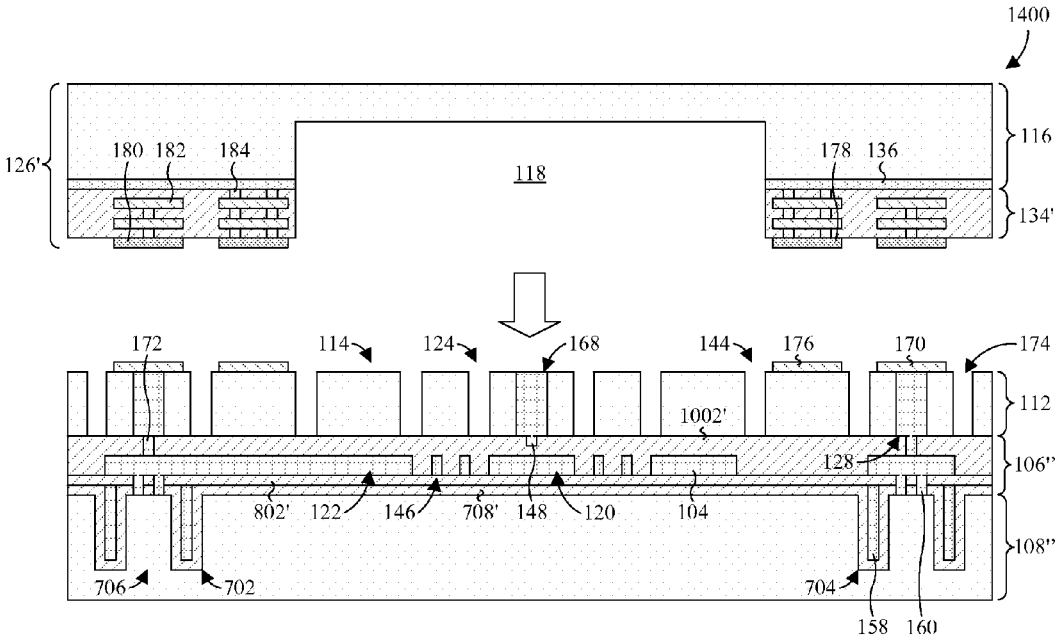

FIGS. 13 and 14 illustrate cross-sectional views 1300, 1400 of some embodiments corresponding to Action 416.

As shown by FIG. 13, a fourth conductive layer 1302 is formed over the remaining second MEMS substrate 112" and the second TSVs 128. The fourth conductive layer 1302 is or otherwise includes a conductor, such as polysilicon or a metal. Typically, the fourth conductive layer 1302 is a metal, such as aluminum, copper, aluminum copper, copper tin, or gold.

As shown by FIG. 14, a seventh etch is performed through select regions of the fourth conductive layer 1302. The seventh etch defines a MEMS bonding ring 176 arranged around the membrane region 120. Further, the seventh etch defines first MEMS contacts pads 170 arranged over the second TSVs 128 outside the MEMS bonding ring 176. The seventh etch includes, for example, one or more sub-etches, each of which is anisotropic, isotropic, or a combination of anisotropic and isotropic, and each of which is a wet etch, a dry etch (e.g., a plasma etch), or a combination of wet and dry etches FIG. 14 illustrates a cross-sectional view 1400 of some embodiments corresponding to Action 418.

As shown by FIG. 14, an eighth etch is performed through select regions of the remaining second MEMS substrate 112". The eighth etch forms TSV isolation holes 174 around the second TSVs 128, and a back plate isolation hole 144 along the inner sidewall of the MEMS bonding ring 176. Regions of the second MEMS substrate 112" surrounded by the back plate isolation hole 144 correspond to a back plate electrode 114. Further, the eighth etch forms inter-volume holes 124 through the back plate electrode 114 to expose sacrificial regions of the remaining first ILD layer 106", including the remaining first, second and third dielectric layers 708', 802', 1002', surrounding the membrane region 120. The eighth etch includes, for example, one or more sub-etches, each of which is anisotropic, isotropic, or a combination of anisotropic and isotropic, and each of which is a wet etch, a dry etch (e.g., a plasma etch), or a combination of wet and dry etches FIG. 14 illustrates a cross-sectional view 1400 of some embodiments corresponding to Action 420.

As shown by FIG. 14, an IC device 126' is provided. The IC device 126' includes an IC substrate 116 having a back volume 118. The IC substrate 116 is a substrate over and/or within which the IC device 126' is formed. Further, the IC substrate 116 is typically a bulk semiconductor substrate including, for example, one or more of silicon, germanium, silicon carbide, a group III element, and a group V element. Alternatively, the IC substrate 116 is, for example, a SOI or POI substrate. An electronic components layer 136 is arranged around the back volume 118 over and/or within a bottom of the IC substrate 116, and a second ILD layer 134' is arranged around the back volume 118 over the electronic components layer 136. Electronic components of the electronic components layer 136 are electrically connected with each other and IC contact pads 180 by interconnect components 182, 184 arranged within the second ILD layer 134'. The IC contact pads 180 are arranged over a bottom of the second ILD layer 134' with an IC bonding ring 178 extending around the back volume 118 between the IC contact pads 180 and the back volume 118. The second ILD layer 134' is or otherwise includes a dielectric, such as, for example, silicon dioxide, silicon oxynitride, or silicon nitride. Typically, the second ILD layer 134' is formed of an oxide, such as silicon dioxide.

Also shown by FIG. 14, the IC device 126' is bonded to the remaining second MEMS substrate 112 with the back volume 118 over the back plate electrode 114 to seal the back volume 118 over the back plate electrode 114. The IC device 126' is typically bonded to the remaining second MEMS substrate 112 by a eutectic bond at the interface between the MEMS and IC bonding rings 176, 178. Further, the IC contact pads 180 electrically couple with corresponding first MEMS contact pads 170, typically with a eutectic bond at the interface.

Figure 15:
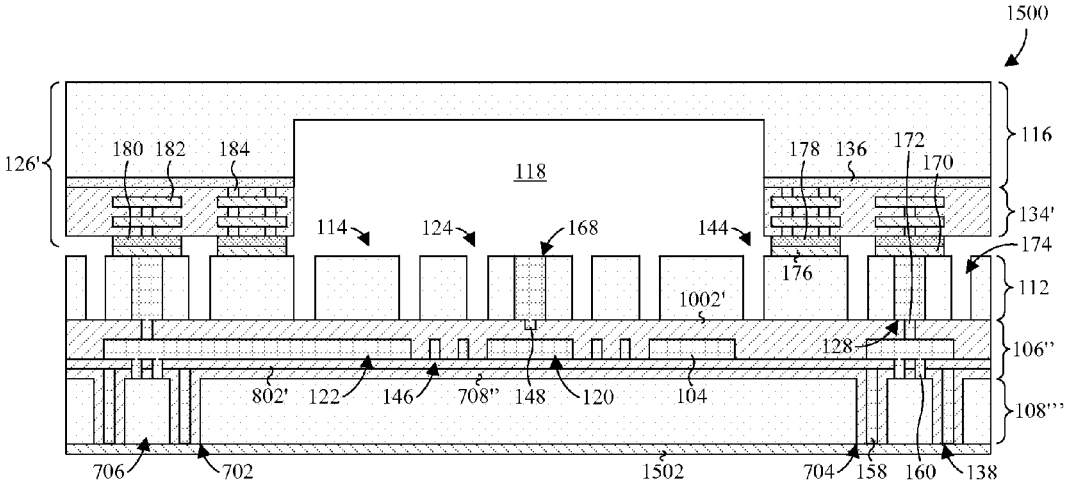

FIG. 15 illustrates a cross-sectional view 1500 of some embodiments corresponding to Action 422.

As shown by FIG. 15, a fifth planarization and/or etch back is performed into the remaining first MEMS substrate 108" and the remaining first dielectric layer 708' to expose the conductive cores 158 and to form first TSVs 138. In some embodiments, the fifth planarization and/or etch back includes a CMP.

Figure 16:
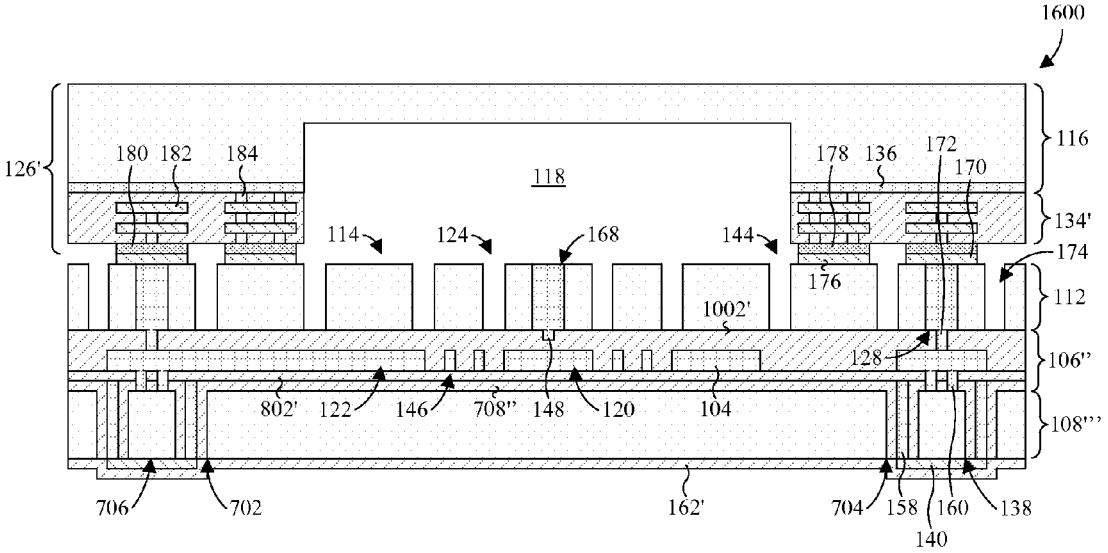

FIGS. 15 and 16 illustrate cross-sectional views 1500, 1600 of some embodiments corresponding to Action 424.

As shown by FIG. 15, a fifth conductive layer 1502 is formed over a bottom of the remaining first MEMS substrate 108", the remaining first dielectric layer 708', and the first TSVs 138. The fifth conductive layer 1502 is or otherwise includes a conductor, such as polysilicon or a metal. Typically, the fifth conductive layer 1502 is a metal, such as aluminum, copper, or aluminum copper.

As shown by FIG. 16, a ninth etch is performed through select regions of the fifth conductive layer 1502 to form second MEMS contact pads 140 over the first TSVs 138. The second MEMS contact pads 140 are in electrical communication with the first TSVs 138 and the conductive MEMS structure 104. The ninth etch includes, for example, one or more sub-etches, each of which is anisotropic, isotropic, or a combination of anisotropic and isotropic, and each of which is a wet etch, a dry etch (e.g., a plasma etch), or a combination of wet and dry etches FIGS. 16-18 illustrate cross-sectional views 1600, 1700, 1800 of some embodiments corresponding to Action 426.

As shown by FIG. 16, a fourth dielectric layer 162' is formed over the remaining first MEMS substrate 108'" and the second MEMS contact pads 140. The fourth dielectric layer 162' is typically formed conformally, and is or otherwise includes a dielectric, such as, for example, silicon dioxide, silicon oxynitride, or silicon nitride. Typically, the fourth dielectric layer 162' is formed of an oxide, such as silicon dioxide.

Figure 17:
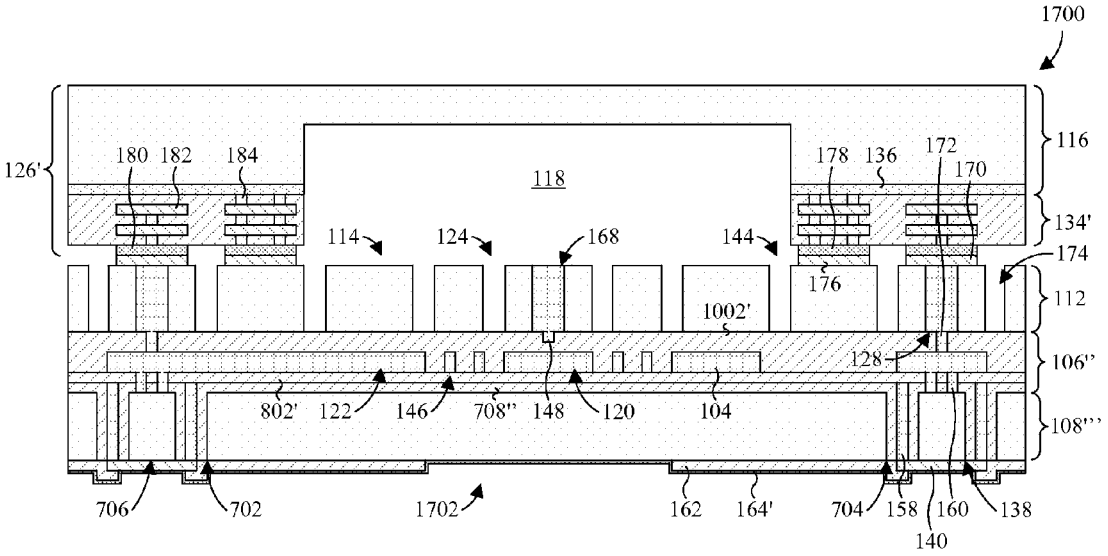

As shown by FIG. 17, a tenth etch is performed through select regions of the fourth dielectric layer 162' to expose the second MEMS contact pads 140 and to expose an environment port region 1702 of the remaining first MEMS substrate 108" below the membrane region 120. Typically, there is a margin or space between the environment port region 1702 and the remaining fourth dielectric layer 162. The tenth etch includes, for example, one or more sub-etches, each of which is anisotropic, isotropic, or a combination of anisotropic and isotropic, and each of which is a wet etch, a dry etch (e.g., a plasma etch), or a combination of wet and dry etches Also shown by FIG. 17, a protective layer 164' is formed over the remaining fourth dielectric layer 162, the environment port region 1702, and the second MEMS contact pads 140. As seen hereafter, the protective layer 164' protects the remaining fourth dielectric layer 162 from vapor hydrofluoric acid. The protective layer 164' is typically formed conformally, and is or otherwise includes, for example, a material resistive to vapor hydrofluoric acid, such as low stress nitride, aluminum nitride, aluminum oxide, or silicon carbide.

Figure 18:
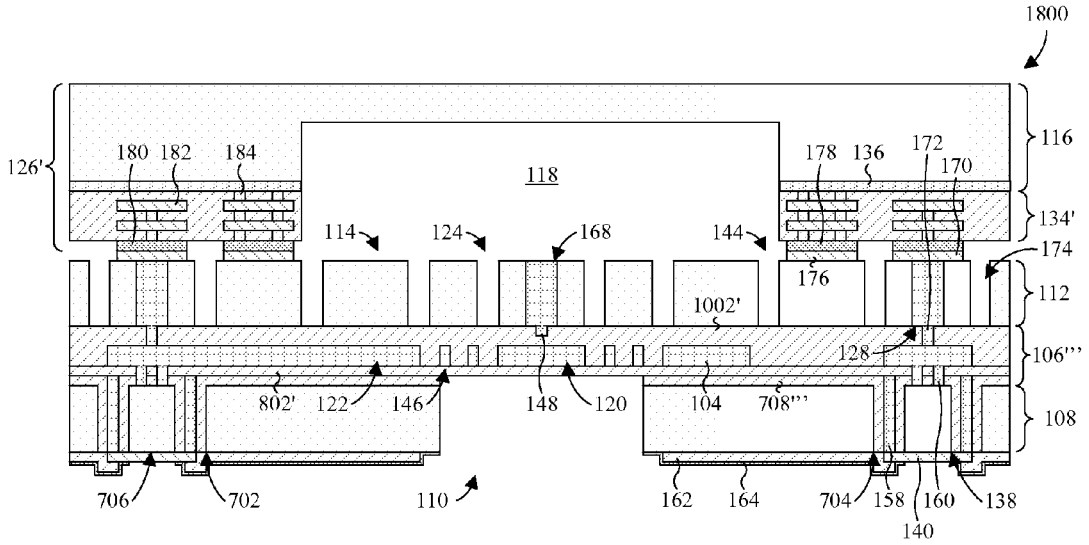

As shown by FIG. 18, an eleventh etch is performed through select regions of the protective layer 164'. The eleventh etch exposes the second MEMS contact pads 140 and the environment port region 1702, while lining or otherwise covering all surfaces of the remaining fourth dielectric layer 162. The eleventh etch includes, for example, one or more sub-etches, each of which is anisotropic, isotropic, or a combination of anisotropic and isotropic, and each of which is a wet etch, a dry etch (e.g., a plasma etch), or a combination of wet and dry etches FIG. 18 illustrates a cross-sectional view 1800 of some embodiments corresponding to Action 428.

As shown by FIG. 18, a twelfth etch is performed through select regions of the protective layer 164' and through the environment port region 1702 to form an environment port 110. In some embodiments, the twelfth etch extends into and/or through the remaining first ILD layer 106", including the remaining first and/or second dielectric layers 708", 802'. The twelfth etch includes, for example, one or more sub-etches, each of which is anisotropic, isotropic, or a combination of anisotropic and isotropic, and each of which is a wet etch, a dry etch (e.g., a plasma etch), or a combination of wet and dry etches FIG. 19 illustrates a cross-sectional view 1900 of some embodiments corresponding to Action 430.

Figure 19:
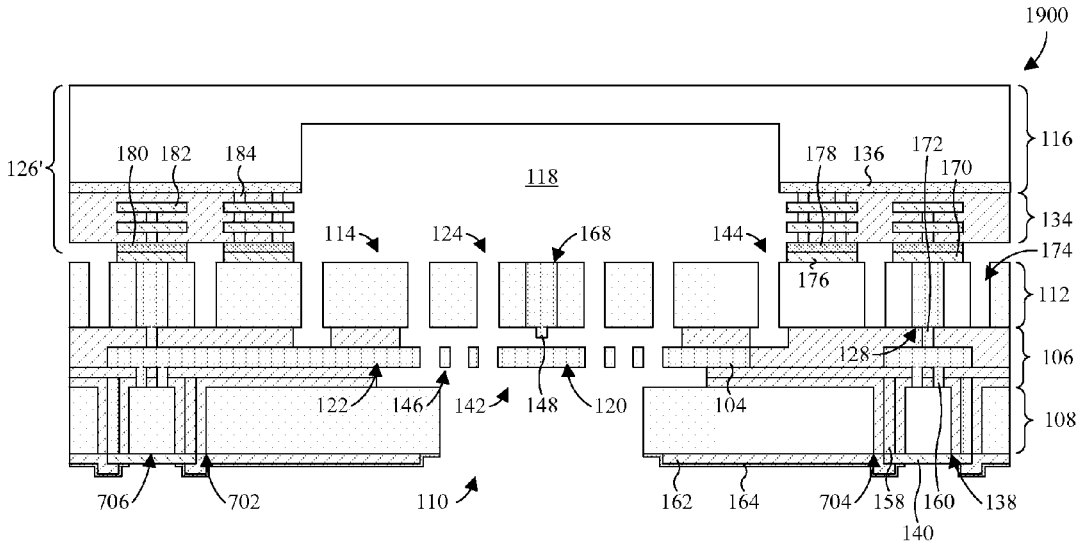

As shown by FIG. 19, a thirteenth etch is performed into the remaining first ILD layer 106'", including the remaining first, second and third dielectric layers 708'", 802', 1002', and the second ILD layer 134' to form a front volume 142 between the remaining first and second MEMS substrates 108, 112 below the back plate electrode 114. In some embodiments, the process for the twelfth etch includes introducing vapor hydrofluoric acid to the remaining first ILD layer 106'" and the second ILD layer 134' through the environment port 110. In other embodiments, the vapor hydrofluoric acid is also introduced through a hole (not shown) in the IC substrate 116' leading to the back volume 118. This hole is subsequently sealed by forming a sealing layer (not shown) thereover. The thirteenth etch includes, for example, one or more sub-etches, each of which is anisotropic, isotropic, or a combination of anisotropic and isotropic, and each of which is a wet etch, a dry etch (e.g., a plasma etch), or a combination of wet and dry etches With reference to FIGS. 20-32, cross-sectional views of some embodiments of a MEMS package at various stages of manufacture are provided to illustrate the method of FIGS. 5A & B. Although FIGS. 20-32 are described in relation to the method, it will be appreciated that the structures disclosed in FIGS. 20-32 are not limited to the method, but instead may stand alone as structures independent of the method. Similarly, although the method is described in relation to FIGS. 20-32, it will be appreciated that the method is not limited to the structures disclosed in FIGS. 20-32, but instead may stand alone independent of the structures disclosed in FIGS. 20-32.

Figure 20:
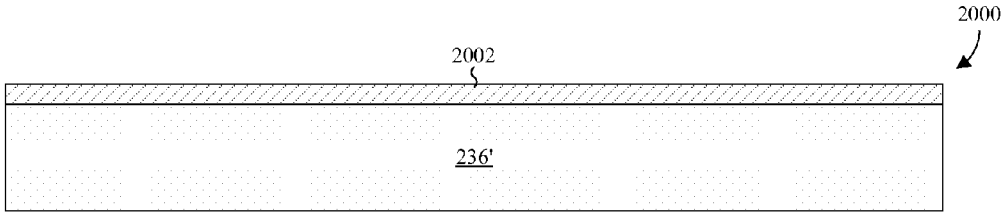

FIG. 20 illustrates a cross-sectional view 2000 of some embodiments corresponding to Action 502.

As shown by FIG. 20, a MEMS substrate 236' is provided. The MEMS substrate 236' is a substrate over and/or within which a MEMS device is formed. The MEMS substrate 236' is typically a bulk semiconductor substrate including, for example, one or more of silicon, germanium, silicon carbide, a group III element, and a group V element. Alternatively, the MEMS substrate 236' is, for example, a SOI or POI substrate.

Also shown by FIG. 20, a first dielectric layer 2002 is formed over the MEMS substrate 236'. The first dielectric layer 2002 is or otherwise includes a dielectric, such as, for example, silicon dioxide, silicon oxynitride, or silicon nitride. Typically, the first dielectric layer 2002 is formed of an oxide, such as silicon dioxide.

Figure 21:
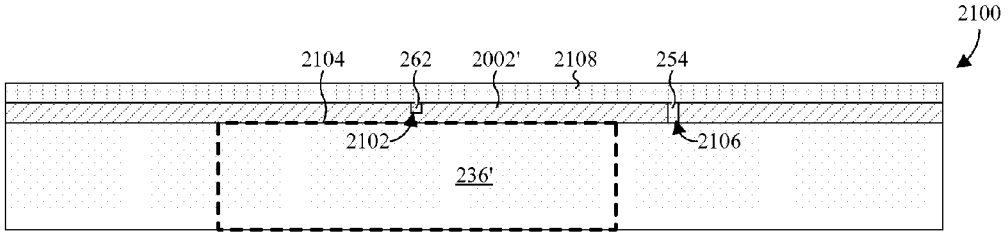

FIG. 21 illustrates a cross-sectional view 2100 of some embodiments corresponding to Actions 504 and 506.

As shown by FIG. 21, a first etch is performed through select regions of the first dielectric layer 2002 to define a stopper hole 2102 over, but not in communication with, a back plate electrode region 2104 (shown in dashed lines) of the MEMS substrate 236'. The first etch includes, for example, one or more sub-etches, each of which is anisotropic, isotropic, or a combination of anisotropic and isotropic, and each of which is a wet etch, a dry etch (e.g., a plasma etch), or a combination of wet and dry etches Also shown by FIG. 21, a second etch is performed through select regions of the first dielectric layer 2002 to define a first contact hole 2106 in communication with regions of the MEMS substrate 236' surrounding the back plate electrode region 2104. The second etch includes, for example, one or more sub-etches, each of which is anisotropic, isotropic, or a combination of anisotropic and isotropic, and each of which is a wet etch, a dry etch (e.g., a plasma etch), or a combination of wet and dry etches Also shown by FIG. 21, a first conductive layer 2108 is formed over the remaining first dielectric layer 2002' and filling the first contact and stopper holes 2106, 2102. Regions of the first conductive layer 2108 filling the first contact and stopper holes 2106, 2102 correspond to a MEMS contact 254 and a stopper 262. The first conductive layer 2108 is or otherwise includes a conductor, such as polysilicon or a metal. Typically, the first conductive layer 2108 is formed of polysilicon.

Figure 22:
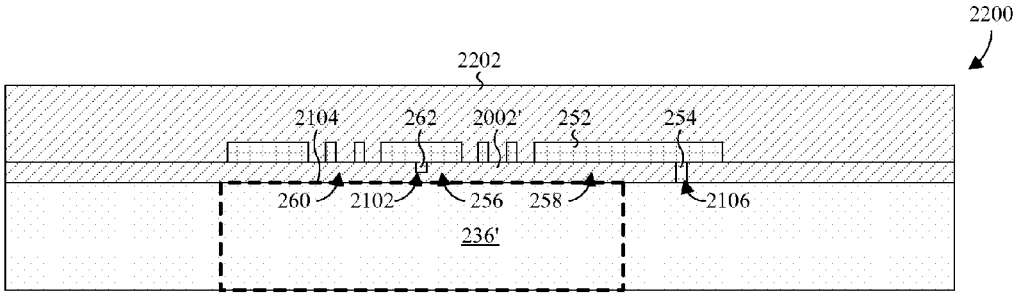

FIG. 22 illustrates a cross-sectional view 2200 of some embodiments corresponding to Action 508.

As shown by FIG. 22, a third etch is performed through select regions of the first conductive layer 2108. The third etch forms a conductive MEMS structure 252 arranged over and in electrical communication with the MEMS contact 254 and the stopper 262. The conductive MEMS structure 252 is tailored to a predetermined type of MEMS device, such as, for example, a microphone, pressure sensor, or any other type of MEMS device requiring environmental exposure. For a microphone, the conductive MEMS structure 252 includes an anchor region 258 arranged around and spaced from a membrane region 256, and connected to the membrane region 256 by spring regions 260. For a pressure sensor, the conductive MEMS structure 252 includes the anchor region 258 directly connected to the membrane region 256. The third etch includes, for example, one or more sub-etches, each of which is anisotropic, isotropic, or a combination of anisotropic and isotropic, and each of which is a wet etch, a dry etch (e.g., a plasma etch), or a combination of wet and dry etches FIGS. 22-24 illustrate cross-sectional views 2200, 2300, 2400 of some embodiments corresponding to Action 510.

As shown by FIG. 22, a second dielectric layer 2202 is formed over the remaining first dielectric layer 2002' and the conductive MEMS structure 252. The second dielectric layer 2202 is or otherwise includes a dielectric, such as, for example, silicon dioxide, silicon oxynitride, or silicon nitride. Typically, the second dielectric layer 2202 is formed of an oxide, such as silicon dioxide.

Figure 23:
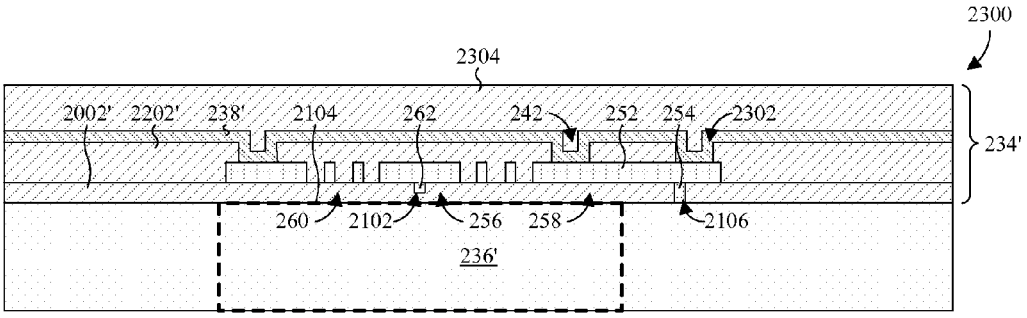
Figure 24:
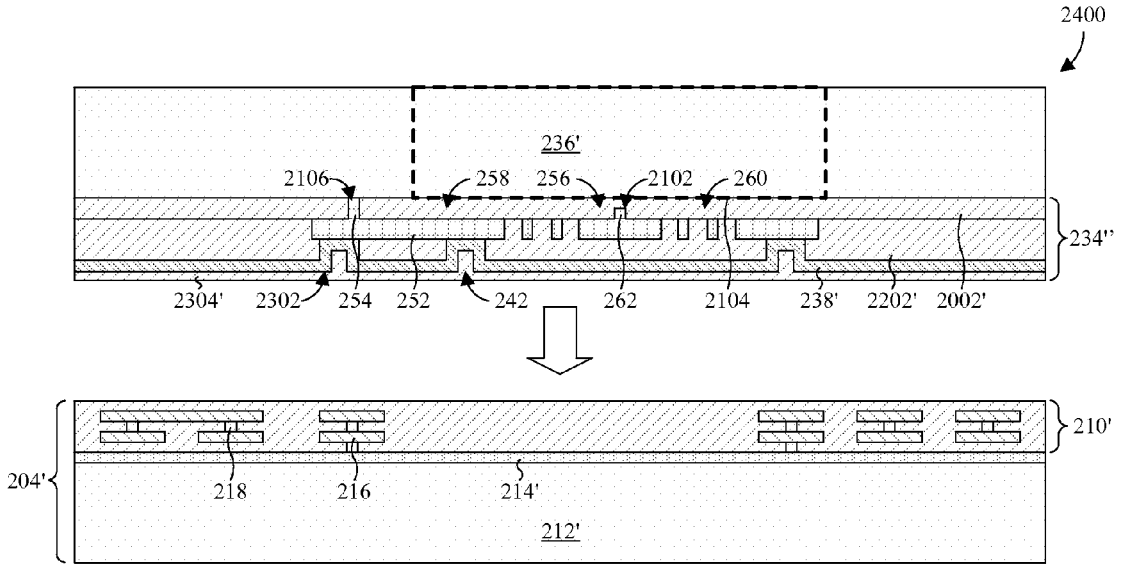

As shown by FIG. 23, a first planarization and/or etch back is performed into the second dielectric layer 2202. In some embodiments, the first planarization and/or etch back includes a CMP.

Also shown by FIG. 23, fourth etch is performed into the second dielectric layer 2202 to define anchor holes 2302 in communication with the anchor region 258. The fourth etch includes, for example, one or more sub-etches, each of which is anisotropic, isotropic, or a combination of anisotropic and isotropic, and each of which is a wet etch, a dry etch (e.g., a plasma etch), or a combination of wet and dry etches Also shown by FIG. 23, an etch stop layer 238' is formed over the remaining second dielectric layer 2202' and lining the anchor holes 2302. Regions of the etch stop layer 238' lining the anchor holes 2302 define ridges 242. The ridges 242 are inverted and provide a lateral etch stop for region of the remaining second dielectric layer 2202' surrounding the anchor region 258. The etch stop layer 238' is typically formed conformally, and is or otherwise includes, for example, a material resistive to vapor hydrofluoric acid, such as low stress nitride, aluminum nitride, aluminum oxide, or silicon carbide.

Also shown by FIG. 23, a third dielectric layer 2304 is formed over the etch stop layer 238' and filling any gaps between the lined sidewalls of the anchor holes 2302. The remaining first and second dielectric layers 2002', 2202' and the third dielectric layer 2304 collectively form a first ILD layer 234'. The third dielectric layer 2304 is or otherwise includes a dielectric, such as, for example, silicon dioxide, silicon oxynitride, or silicon nitride. Typically, the third dielectric layer 2304 is formed of an oxide, such as silicon dioxide.

As shown by FIG. 24, a second planarization and/or etch back is performed into the third dielectric layer 2304 and the first ILD layer 234'. In some embodiments, the second planarization and/or etch back includes a CMP.

FIG. 24 illustrates a cross-sectional view 2400 of some embodiments corresponding to Action 512.

As shown by FIG. 24, an IC device 204' is provided. The IC device 204' includes an IC substrate 212' over which interconnect components 216, 218 of the IC device 204' connect electronic components of an electronic components layer 214' of the IC device 204'. The IC substrate 212' is a substrate over and/or within which the IC device 204' is formed. Further, the IC substrate 212' is typically a bulk semiconductor substrate including, for example, one or more of silicon, germanium, silicon carbide, a group III element, and a group V element. Alternatively, the IC substrate 212' is, for example, a SOI or POI substrate. The electronic components layer 214' is arranged over and/or within the IC substrate 212', and a second ILD layer 210' is over the electronic components layer 214' around the interconnect components 216, 218. The second ILD layer 210' is or otherwise includes a dielectric, such as, for example, silicon dioxide, silicon oxynitride, or silicon nitride. Typically, the second ILD layer 210' is formed of an oxide, such as silicon dioxide.

Also shown by FIG. 24, the IC device 204' is bonded to the MEMS substrate 236' through the remaining first ILD layer 234", including the remaining third dielectric layer 2304'. The IC device 204' is typically bonded to the MEMS substrate 236' by a fusion bond at the interface between the remaining first ILD layer 234" and the second ILD layer 210'.

Figure 25:
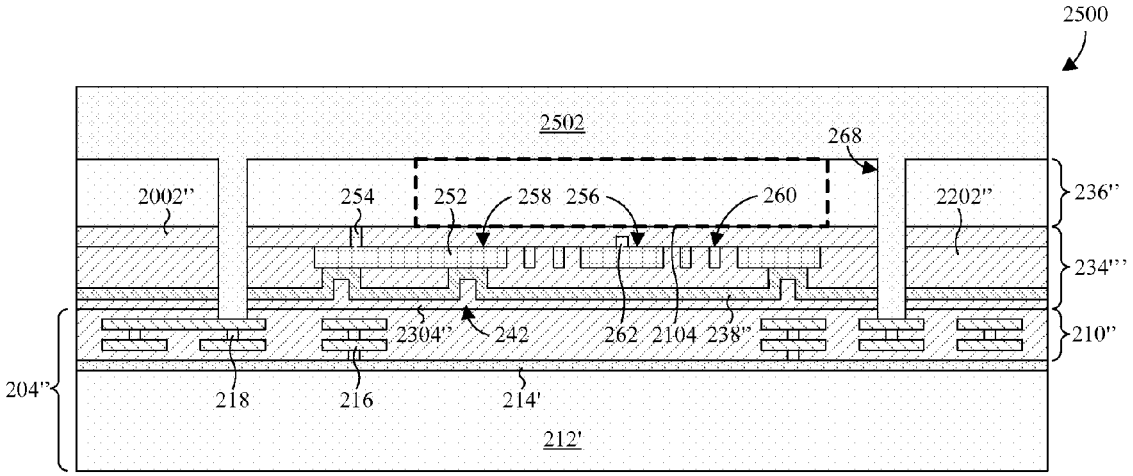
Figure 26:
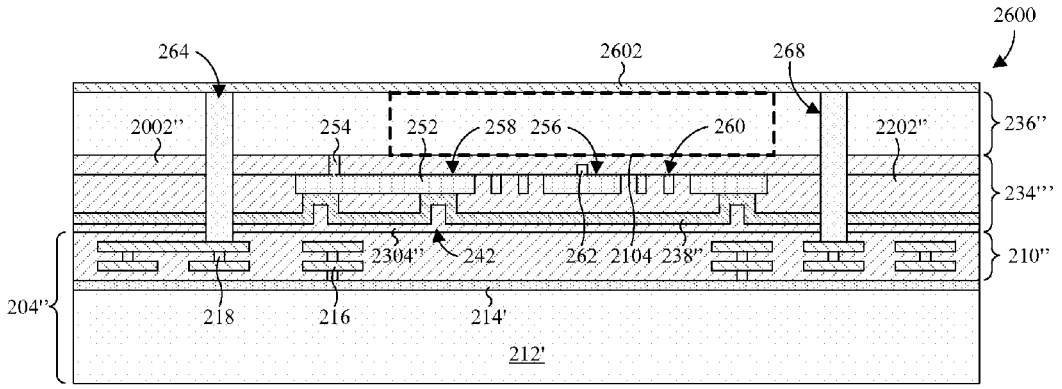

FIGS. 25 and 26 illustrate cross-sectional views 2500, 2600 of some embodiments corresponding to Action 514.

As shown by FIG. 25, a third planarization and/or etch back is performed into the MEMS substrate 236' to thin down the MEMS substrate 236' to the desired thickness. In some embodiments, the third planarization and/or etch back includes a CMP.

Also shown by FIG. 25, a fifth etch is performed is performed through and/or into select regions of the MEMS substrate 236', the remaining first ILD layer 234", the etch stop layer 238', and the second ILD layer 210' to the interconnect components 216, 218 of the IC device 204'. The fifth etch results in second TSV holes 268. The fifth etch includes, for example, one or more sub-etches, each of which is anisotropic, isotropic, or a combination of anisotropic and isotropic, and each of which is a wet etch, a dry etch (e.g., a plasma etch), or a combination of wet and dry etches Also shown by FIG. 25, a second conductive layer 2502 is formed over the remaining MEMS substrate 236" and filling the second TSV holes 268. The second conductive layer 2502 is or otherwise includes a conductor, such as polysilicon or a metal. Typically, the second conductive layer 2502 is formed of a metal, such as tungsten.

As shown by FIG. 26, a fourth planarization and/or etch back is performed into the second conductive layer 2502 to form second TSVs 264 extending through the remaining MEMS substrate 236", the remaining first ILD layer 234", including the remaining first, second and third dielectric layers 2002", 2202", 2304", the remaining etch stop layer 238", and the remaining second ILD layer 210". In some embodiments, the fourth planarization and/or etch back includes a CMP.

Figure 27:
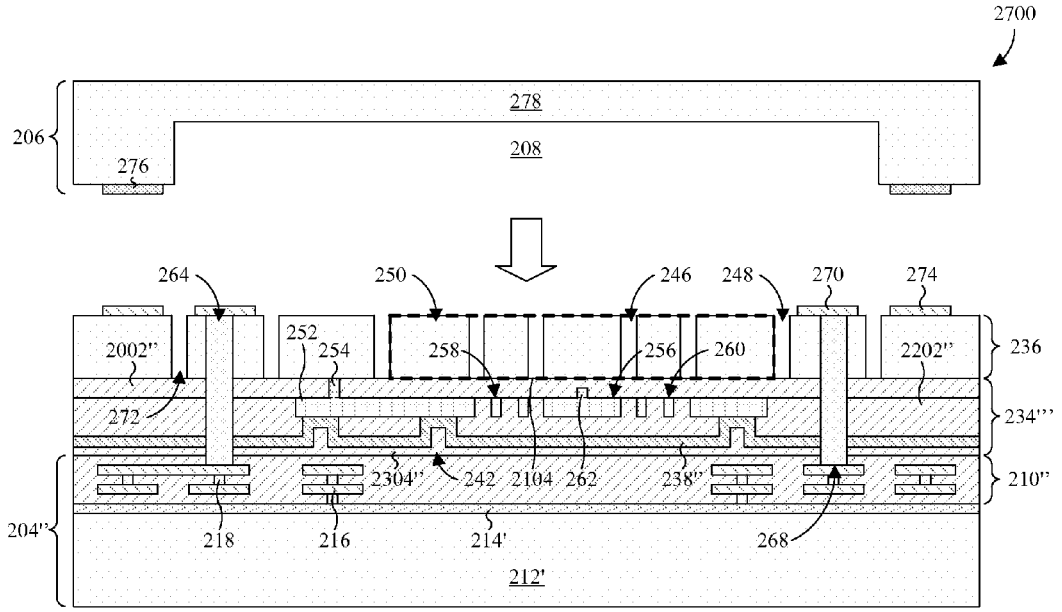

FIGS. 26 and 27 illustrate cross-sectional views 2600, 2700 of some embodiments corresponding to Action 516.

As shown by FIG. 26, a third conductive layer 2602 is formed over the remaining MEMS substrate 236" and the second TSVs 264. The third conductive layer 2602 is or otherwise includes a conductor, such as polysilicon or a metal. Typically, the third conductive layer 2602 is a metal, such as aluminum, copper, or aluminum copper.

As shown by FIG. 27, a sixth etch is performed through select regions of the third conductive layer 2602. The sixth etch defines a MEMS bonding ring 274 arranged around the membrane region 256. Further, the sixth etch defines MEMS contacts pads 270 arranged over the second TSVs 264 inside the MEMS bonding ring 274. The sixth etch includes, for example, one or more sub-etches, each of which is anisotropic, isotropic, or a combination of anisotropic and isotropic, and each of which is a wet etch, a dry etch (e.g., a plasma etch), or a combination of wet and dry etches FIG. 27 illustrates a cross-sectional view 2700 of some embodiments corresponding to Actions 518 and 520.

As shown by FIG. 27, a seventh etch is performed through select regions of the remaining MEMS substrate 236". The seventh etch forms TSV isolation holes 272 around the second TSVs 264, and a back plate isolation hole 248 around the back plate electrode region 2104 of the remaining MEMS substrate 236. Regions of the remaining MEMS substrate 236" surrounded by the back plate isolation hole 248 correspond to a back plate electrode 250. Further, the seventh etch forms inter-volume holes 246 through the back plate electrode region 2104 to expose sacrificial regions of the remaining first ILD layer 234', including the remaining first, second and third dielectric layers 2002", 2202", 2304" surrounding the membrane region 256. The seventh etch includes, for example, one or more sub-etches, each of which is anisotropic, isotropic, or a combination of anisotropic and isotropic, and each of which is a wet etch, a dry etch (e.g., a plasma etch), or a combination of wet and dry etches Also shown by FIG. 27, a cap device 206 is provided. The cap device 206 includes a cap substrate 278 having a back volume 208. The cap substrate 278 is a substrate over and/or within which the cap device 206 is formed. Further, the cap substrate 278 is typically a bulk semiconductor substrate including, for example, one or more of silicon, germanium, silicon carbide, a group III element, and a group V element. Alternatively, the cap substrate 278 is, for example, a SOI or POI substrate. The cap device 206 further includes a cap bonding ring 276 extending around the back volume 208.

Also shown by FIG. 27, the cap device 206 is bonded to the remaining MEMS substrate 236 with the back volume 208 over the back plate electrode 250 to seal the back volume 208 over the back plate electrode 250. The cap device 206 is typically bonded to the remaining MEMS substrate 236 by a eutectic bond at the interface between MEMS and cap bonding rings 274, 276.

Figure 28:
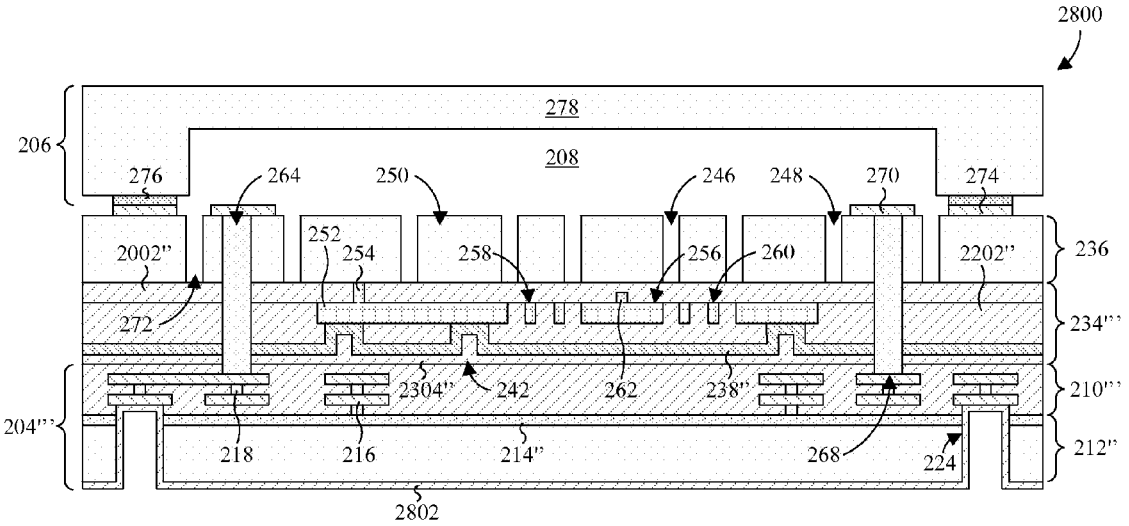
Figure 29:
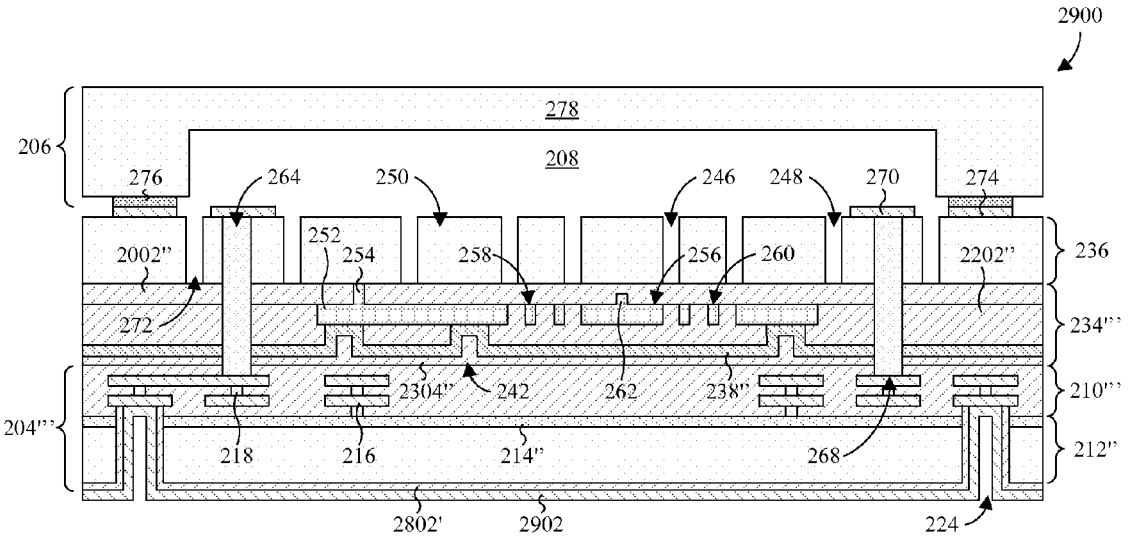
Figure 30:
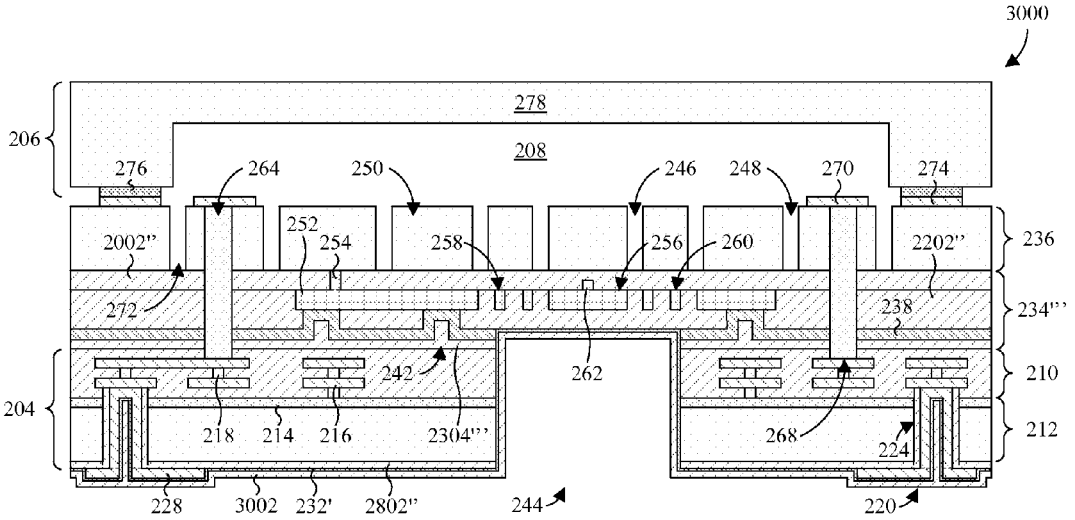

FIG. 28-30 illustrates a cross-sectional view 2800, 2900, 3000 of some embodiments corresponding to Action 522.

As shown by FIG. 28, a fifth planarization and/or etch back is performed into the IC substrate 212' to thin down the IC substrate 212' to the desired thickness. In some embodiments, the fifth planarization and/or etch back includes a CMP.

Also shown by FIG. 28, an eighth etch is performed through and/or into select regions of the IC substrate 212', the electronic components layer 214', and the remaining second ILD layer 210" to the interconnect components 216, 218. The eighth etch result in first TSV holes 224. The eighth etch includes, for example, one or more sub-etches, each of which is anisotropic, isotropic, or a combination of anisotropic and isotropic, and each of which is a wet etch, a dry etch (e.g., a plasma etch), or a combination of wet and dry etches Also shown by FIG. 28, a fourth dielectric layer 2802 is formed over the remaining IC substrate 212" and lining the first TSV holes 224. The fourth dielectric layer 2802 is typically formed conformally, and is or otherwise includes a dielectric, such as, for example, silicon dioxide, silicon oxynitride, or silicon nitride. Typically, the fourth dielectric layer 2802 is formed of an oxide, such as silicon dioxide.

As shown by FIG. 29, an ninth etch is performed through select regions of the fourth dielectric layer 2802 to expose the interconnects component 216, 218. The ninth etch includes, for example, one or more sub-etches, each of which is anisotropic, isotropic, or a combination of anisotropic and isotropic, and each of which is a wet etch, a dry etch (e.g., a plasma etch), or a combination of wet and dry etches Also shown by FIG. 29, a fourth conductive layer 2902 is formed over the remaining fourth dielectric layer 2802' and the exposed interconnect components 216, 218. The fourth conductive layer 2902 is or otherwise includes a conductor, such as polysilicon or a metal. Typically, the fourth conductive layer 2902 is formed conformally, and/or is a metal, such as aluminum, copper, or aluminum copper.

As shown by FIG. 30, a tenth etch is performed through select regions of the fourth conductive layer 2902 to form first TSVs 220 extending through the remaining IC substrate 212", the remaining electronic components layer 214", and the remaining second ILD layer 210'" to the interconnect components 216, 218. The tenth etch also forms IC contact pads 228 arranged next to the first TSVs 220 in electrical communication with the first TSVs 220. The tenth etch includes, for example, one or more sub-etches, each of which is anisotropic, isotropic, or a combination of anisotropic and isotropic, and each of which is a wet etch, a dry etch (e.g., a plasma etch), or a combination of wet and dry etches FIG. 30 illustrates a cross-sectional view 3000 of some embodiments corresponding to Action 524.

As shown by FIG. 30, an eleventh etch is performed through select regions of the remaining fourth dielectric layer 2802', the remaining IC substrate 212", the remaining second ILD layer 210'", and the remaining etch stop layer 238" to form an environment port 244 below the membrane region 256. The eleventh etch includes, for example, one or more sub-etches, each of which is anisotropic, isotropic, or a combination of anisotropic and isotropic, and each of which is a wet etch, a dry etch (e.g., a plasma etch), or a combination of wet and dry etches FIGS. 30 and 31 illustrate cross-sectional views 3000, 3100 of some embodiments corresponding to Action 526.

As shown by FIG. 30, a protective layer 232' is formed over the remaining IC substrate 212, the IC contact pads 228, and the first TSVs 220. The protective layer 232' is also formed lining the environment port 244 and any free space in the first TSV holes 224. As seen hereafter, the protective layer 232' protects the remaining fourth dielectric layer 2802" from vapor hydrofluoric acid. The protective layer 232' is typically formed conformally, and is or otherwise includes, for example, a material resistive to vapor hydrofluoric acid, such as low stress nitride, aluminum nitride, aluminum oxide, or silicon carbide.

Also shown by FIG. 30, a fifth dielectric layer 3002 is formed over the protective layer 232'. The fifth dielectric layer 3002 is typically formed conformally, and is or otherwise includes a dielectric, such as, for example, silicon dioxide, silicon oxynitride, or silicon nitride. Typically, the fifth dielectric layer 3002 is formed of an oxide, such as silicon dioxide.

Figure 31:
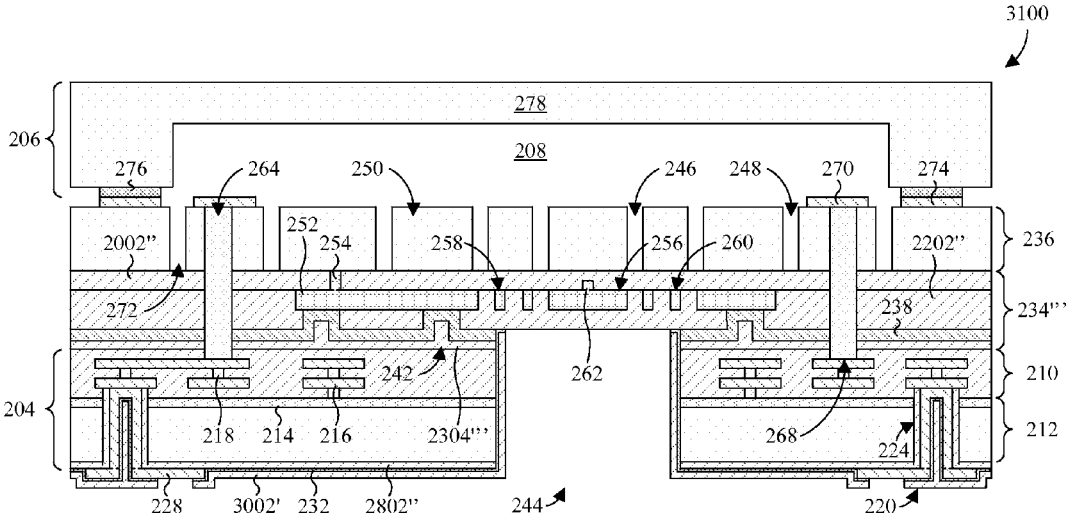

As shown by FIG. 31, a twelfth etch is performed through the protective layer 232' and the fifth dielectric layer 3002 to expose a top surface of the environment port 244 and to expose the IC contact pads 228. The twelfth etch includes, for example, one or more sub-etches, each of which is anisotropic, isotropic, or a combination of anisotropic and isotropic, and each of which is a wet etch, a dry etch (e.g., a plasma etch), or a combination of wet and dry etches FIG. 32 illustrate cross-sectional views 3200 of some embodiments corresponding to Action 528.

Figure 32:
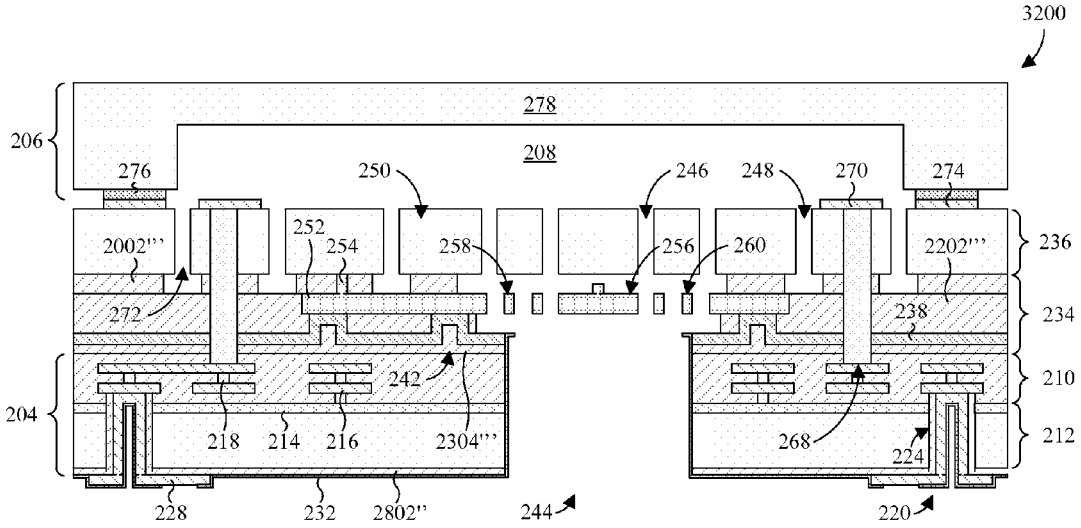

As shown by FIG. 32, a thirteenth etch is performed into the remaining first ILD layer 234", including the remaining first and second dielectric layers 2002", 2202", and through the remaining fifth dielectric layer 3002. During the thirteenth etch, the remaining protective layer 232 and the remaining etch stop layer 238 protect the remaining second ILD layer 210 and the remaining third dielectric layer 2304'". In some embodiments, the process for the thirteenth etch includes introducing vapor hydrofluoric acid to the remaining first ILD layer 234'" through the environment port 244. In other embodiments, the vapor hydrofluoric acid is also introduced through a hole (not shown) in the cap substrate 278 leading to the back volume 208. This hole is subsequently sealed by forming a sealing layer (not shown) thereover. The thirteenth etch includes, for example, one or more sub-etches, each of which is anisotropic, isotropic, or a combination of anisotropic and isotropic, and each of which is a wet etch, a dry etch (e.g., a plasma etch), or a combination of wet and dry etches Thus, as can be appreciated from above, the present disclosure provides a MEMS package. A conductive MEMS structure is arranged in an ILD layer and includes a membrane region extending across a first volume arranged in the ILD layer. A first substrate is bonded to a second substrate through the ILD layer. A MEMS device includes the second substrate. A TSV extends through the second substrate to electrically couple the MEMS device to an IC device. A third substrate is bonded to the second substrate to define a second volume between the second substrate and the third substrate. The IC device includes the first or third substrate.

In other embodiments, the present disclosure provides a method for manufacturing a MEMS package. A conductive MEMS structure is formed in an ILD layer. The conductive MEMS structure includes a membrane region extending across an ILD region corresponding to a first volume. A first bonding of a first wafer to a second wafer is performed through the ILD layer. A MEMS device includes the second wafer. A TSV is formed extending through the second wafer to electrically couple the MEMS device to an IC device. A second bonding of a third wafer to the second wafer is performed over the second wafer to define a second volume between the second wafer and the third wafer. The IC device includes the first or third wafer.

In yet other embodiments, the present disclosure provides a MEMS package. A MEMS device includes a MEMS substrate. An IC device includes an IC substrate bonded to the MEMS substrate over or below the MEMS substrate. The IC device is further electrically coupled to the MEMS device with a TSV extending through the MEMS substrate. A conductive membrane is arranged below the MEMS substrate between the MEMS substrate and a first substrate, and is arranged across a first volume arranged between the MEMS substrate and the first substrate. A second volume is arranged over the MEMS device between the MEMS substrate and a second substrate. The IC substrate is one of the first substrate and the second substrate. An environment port extends through the first substrate to the first volume and is configured to expose the conductive membrane to an external environment of the MEMS package.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A microelectromechanical systems (MEMS) package comprising:

a conductive MEMS structure arranged in a dielectric layer and including a membrane region extending across a first volume arranged in the dielectric layer;

a first substrate bonded to a second substrate through the dielectric layer, wherein a MEMS device includes the second substrate;

a through silicon via (TSV) extending through the second substrate to electrically couple the MEMS device to an IC device; and a third substrate bonded to the second substrate to define a second volume between the second substrate and the third substrate, wherein the IC device includes the first or third substrate.

2. The MEMS package according to claim 1, wherein the MEMS device is a microphone.

3. The MEMS package according to claim 1, further including:

an environment port extending through the first substrate to the first volume and configured to expose the membrane region to an external environment of the MEMS package.

4. The MEMS package according to claim 1, wherein the IC device includes the third substrate.

5. The MEMS package according to claim 1, wherein the IC device includes the first substrate, and wherein the MEMS package further includes:

a cap device including the third substrate.

6. The MEMS package according to claim 1, further including:

a back plate electrode arranged in the second substrate over the membrane region and capacitively coupled with the membrane region.

7. The MEMS package according to claim 1, further including:

a second dielectric layer arranged between the first substrate and the second substrate below the dielectric layer; and an etch stop layer arranged in the dielectric layer, and configured to define surfaces of the first volume and to protect a fusion bond interface between the dielectric layer and the second dielectric layer.

8. The MEMS package according to claim 7, wherein the etch stop layer is configured to protect the dielectric layer from vapor hydrofluoric acid.

9. The MEMS package according to claim 1, wherein the conductive MEMS structure includes an anchor region around a periphery of the first volume and connected to the membrane region by spring regions, and wherein the anchor region protrudes laterally into the first volume from within the dielectric layer.

10. A microelectromechanical systems (MEMS) package comprising:

a MEMS device having a MEMS substrate;

an integrated circuit (IC) device having an IC substrate bonded to the MEMS substrate over or below the MEMS substrate, and electrically coupled to the MEMS device with a through substrate via (TSV) extending through the MEMS substrate;

a conductive membrane arranged below the MEMS substrate between the MEMS substrate and a first substrate, and arranged across a first volume arranged between the MEMS substrate and the first substrate;

a second volume arranged over the MEMS device between the MEMS substrate and a second substrate, wherein the IC substrate is one of the first substrate and the second substrate; and an environment port extending through the first substrate to the first volume and configured to expose the conductive membrane to an external environment of the MEMS package.

11. The MEMS package according to claim 10, wherein the MEMS device is a microphone.

12. The MEMS package according to claim 10, further comprising:

a first dielectric layer arranged between the first substrate and the MEMS substrate; and a first etch stop layer arranged in the first dielectric layer and configured to define surfaces of the first volume, wherein the environment port extends through the first etch stop layer.

13. The MEMS package according to claim 12, further comprising:

a second dielectric layer arranged between the first dielectric layer and the first substrate, and interfacing with the first dielectric layer at a fusion bond; and a second etch stop layer lining the environment port, and configured to protect the second dielectric layer from an etchant.

14. The MEMS package according to claim 10, further comprising:

a silicon via extending through the first substrate to a bond pad on a lower surface of the first substrate;

a dielectric layer arranged on the lower surface of the first substrate; and an etch stop layer confined to below the lower surface of the first substrate, lining the dielectric layer, and configured to protect the dielectric layer from an etchant.

15. The MEMS package according to claim 10, wherein the IC substrate is the first substrate, and wherein the MEMS package further includes:

a cap device including the second substrate.

16. A microelectromechanical systems (MEMS) package comprising:

a MEMS device comprising a dielectric layer laterally surrounding a first volume, and further comprising a conductive membrane and a MEMS substrate, the conductive membrane arranged in the first volume, and the MEMS substrate arranged over and interfacing with the dielectric layer;

an integrated circuit (IC) device bonded to the MEMS device, and electrically coupled to the MEMS device with a through substrate via (TSV) extending through the MEMS substrate;

an environment port arranged on a lower side of the first volume and configured to expose the conductive membrane to an external environment of the MEMS package; and a second volume arranged over the MEMS substrate in fluid communication with the first volume through the MEMS substrate.

17. The MEMS package according to claim 16, wherein the IC device is arranged over the MEMS substrate, and comprises an IC substrate and an interlayer dielectric (ILD) layer, wherein the IC substrate is bonded to the MEMS substrate through the ILD layer, and wherein the second volume is arranged between the IC substrate and the MEMS substrate.

18. The MEMS package according to claim 16, wherein the IC device is arranged below the dielectric layer, and comprises an IC substrate and an interlayer dielectric (ILD) layer, wherein the IC substrate is bonded to the MEMS substrate through a fusion bond interface between the ILD layer and the dielectric layer, and wherein the environment port extends through the IC device.

19. The MEMS package according to claim 18, further comprising:

an etch stop layer arranged in the dielectric layer, and configured to define surfaces of the first volume and to protect the fusion bond interface from an etchant.

20. The MEMS package according to claim 18, further comprising:

a cap substrate arranged over and bonded to the MEMS substrate, wherein the second volume is arranged between the cap substrate and the MEMS substrate.

* * * * *